US008924053B2

(12) United States Patent
Itoi et al.

(10) Patent No.: US 8,924,053 B2
(45) Date of Patent: Dec. 30, 2014

(54) VESSEL STEERING SYSTEM

(75) Inventors: Makoto Itoi, Chiyoda-ku (JP); Yasuji Sekimoto, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 898 days.

(21) Appl. No.: 12/760,213

(22) Filed: Apr. 14, 2010

(65) Prior Publication Data

US 2011/0106347 A1 May 5, 2011

(30) Foreign Application Priority Data

Nov. 2, 2009 (JP) ..... 2009-252008

(51) Int. Cl.

| | |
|---|---|
| ***B60L 3/00*** | (2006.01) |
| ***B60L 15/00*** | (2006.01) |
| ***G05D 1/00*** | (2006.01) |
| ***G05D 3/00*** | (2006.01) |
| ***G06F 7/00*** | (2006.01) |
| ***B63H 25/42*** | (2006.01) |
| ***B63H 20/12*** | (2006.01) |
| ***B63H 25/02*** | (2006.01) |

(52) U.S. Cl.

CPC ..... *B63H 25/42* (2013.01); *B63H 20/12* (2013.01); *B63H 25/02* (2013.01)

USPC ..... 701/21

(58) Field of Classification Search

CPC ..... B63H 20/12; B63H 25/42; B63H 25/02

USPC ..... 701/21

See application file for complete search history.

(56) References Cited

U.S. PATENT DOCUMENTS

| | | | | |
|---|---|---|---|---|
| 2009/0105894 | A1 * | 4/2009 | Yamamura et al. | 701/21 |
| 2011/0028057 | A1 * | 2/2011 | Torrangs et al. | 440/53 |

FOREIGN PATENT DOCUMENTS

| | | | |
|---|---|---|---|
| JP | 2006-321422 | A | 11/2006 |
| JP | 2009-101716 | A | 5/2009 |

* cited by examiner

*Primary Examiner* — Maceeh Anwari

(74) *Attorney, Agent, or Firm* — Sughrue Mion, PLLC; Richard C. Turner

(57) ABSTRACT

A vessel steering system is provided with a control unit that calculates a control pivoting angle for pivoting the propulsion means based on a steering angle. Based on actual-state recognition of at least one of the type of the vessel, the type of the propulsion means, an actual pivoting angle of a neighboring propulsion means that is close to the propulsion means when a plurality of propulsion means is provided, the distance between the swivel shaft of a reference propulsion means and the swivel shaft of a neighboring propulsion means thereof at a time when a plurality of propulsion means is provided, and the mounting position of the propulsion means on the vessel, the control unit sets a pivoting limit angle for limiting the pivoting of the propulsion means, and controls the pivoting apparatus in such a way that the propulsion means does not pivot by more than the set pivoting limit angle.

16 Claims, 14 Drawing Sheets

L1

| PORT ENGINE (STARBOARD-DIRECTION PIVOTING) | | NEIGHBORING-ENGINE ACTUAL PIVOTING ANGLE (deg) | | | | | | | | | | | | |
|---|---|---|---|---|---|---|---|---|---|---|---|---|---|---|
| | | -60 | -50 | -40 | -30 | -20 | -10 | 0 | 10 | 20 | 30 | 40 | 50 | 60 |
| SWIVEL CENTER DISTANCE (mm) | 100 | -50 | -40 | -30 | -20 | -10 | 0 | 10 | 20 | 30 | 40 | 50 | 60 | 60 |
| | 200 | -46 | -36 | -26 | -16 | -6 | 4 | 14 | 24 | 34 | 44 | 54 | 60 | 60 |
| | 300 | -44 | -34 | -24 | -14 | -4 | 6 | 16 | 26 | 36 | 46 | 56 | 60 | 60 |
| | 400 | -42 | -32 | -22 | -12 | -2 | 8 | 18 | 28 | 38 | 48 | 58 | 60 | 60 |
| | 500 | -40 | -30 | -20 | -10 | 0 | 10 | 20 | 30 | 40 | 50 | 60 | 60 | 60 |
| | 600 | -38 | -28 | -18 | -8 | 2 | 12 | 22 | 32 | 42 | 52 | 60 | 60 | 60 |

L2

| PORT ENGINE (PORT-DIRECTION PIVOTING) | | NEIGHBORING-ENGINE ACTUAL PIVOTING ANGLE (deg) | | | | | | | | | | | | |
|---|---|---|---|---|---|---|---|---|---|---|---|---|---|---|
| | | -60 | -50 | -40 | -30 | -20 | -10 | 0 | 10 | 20 | 30 | 40 | 50 | 60 |
| SWIVEL CENTER DISTANCE (mm) | 100 | -60 | -60 | -60 | -60 | -60 | -60 | -60 | -60 | -60 | -60 | -60 | -60 | -60 |
| | 200 | -60 | -60 | -60 | -60 | -60 | -60 | -60 | -60 | -60 | -60 | -60 | -60 | -60 |
| | 300 | -60 | -60 | -60 | -60 | -60 | -60 | -60 | -60 | -60 | -60 | -60 | -60 | -60 |
| | 400 | -60 | -60 | -60 | -60 | -60 | -60 | -60 | -60 | -60 | -60 | -60 | -60 | -60 |
| | 500 | -60 | -60 | -60 | -60 | -60 | -60 | -60 | -60 | -60 | -60 | -60 | -60 | -60 |
| | 600 | -60 | -60 | -60 | -60 | -60 | -60 | -60 | -60 | -60 | -60 | -60 | -60 | -60 |

R1

| STARBOARD ENGINE (STARBOARD-DIRECTION PIVOTING) | | NEIGHBORING-ENGINE ACTUAL PIVOTING ANGLE (deg) | | | | | | | | | | | | |
|---|---|---|---|---|---|---|---|---|---|---|---|---|---|---|
| | | -60 | -50 | -40 | -30 | -20 | -10 | 0 | 10 | 20 | 30 | 40 | 50 | 60 |
| SWIVEL CENTER DISTANCE (mm) | 100 | 60 | 60 | 60 | 60 | 60 | 60 | 60 | 60 | 60 | 60 | 60 | 60 | 60 |
| | 200 | 60 | 60 | 60 | 60 | 60 | 60 | 60 | 60 | 60 | 60 | 60 | 60 | 60 |
| | 300 | 60 | 60 | 60 | 60 | 60 | 60 | 60 | 60 | 60 | 60 | 60 | 60 | 60 |
| | 400 | 60 | 60 | 60 | 60 | 60 | 60 | 60 | 60 | 60 | 60 | 60 | 60 | 60 |
| | 500 | 60 | 60 | 60 | 60 | 60 | 60 | 60 | 60 | 60 | 60 | 60 | 60 | 60 |
| | 600 | 60 | 60 | 60 | 60 | 60 | 60 | 60 | 60 | 60 | 60 | 60 | 60 | 60 |

R2

| STARBOARD ENGINE (PORT-DIRECTION PIVOTING) | | NEIGHBORING-ENGINE ACTUAL PIVOTING ANGLE (deg) | | | | | | | | | | | | |
|---|---|---|---|---|---|---|---|---|---|---|---|---|---|---|
| | | -60 | -50 | -40 | -30 | -20 | -10 | 0 | 10 | 20 | 30 | 40 | 50 | 60 |
| SWIVEL CENTER DISTANCE (mm) | 100 | -60 | -60 | -50 | -40 | -30 | -20 | -10 | 0 | 10 | 20 | 30 | 40 | 50 |
| | 200 | -60 | -60 | -54 | -44 | -34 | -24 | -14 | -4 | 6 | 16 | 26 | 36 | 46 |
| | 300 | -60 | -60 | -56 | -46 | -36 | -26 | -16 | -6 | 4 | 14 | 24 | 34 | 44 |
| | 400 | -60 | -60 | -58 | -48 | -38 | -28 | -18 | -8 | 2 | 12 | 22 | 32 | 42 |
| | 500 | -60 | -60 | -60 | -50 | -40 | -30 | -20 | -10 | 0 | 10 | 20 | 30 | 40 |
| | 600 | -60 | -60 | -60 | -52 | -42 | -32 | -22 | -12 | -2 | 8 | 18 | 28 | 38 |

S1

| MIDDLE ENGINE (STARBOARD-DIRECTION PIVOTING) | | NEIGHBORING-ENGINE ACTUAL PIVOTING ANGLE (deg) | | | | | | | | | | | | |
|---|---|---|---|---|---|---|---|---|---|---|---|---|---|---|
| | | -60 | -50 | -40 | -30 | -20 | -10 | 0 | 10 | 20 | 30 | 40 | 50 | 60 |
| SWIVEL CENTER DISTANCE (mm) | 100 | -50 | -40 | -30 | -20 | -10 | 0 | 10 | 20 | 30 | 40 | 50 | 60 | 60 |
| | 200 | -46 | -36 | -26 | -16 | -6 | 4 | 14 | 24 | 34 | 44 | 54 | 60 | 60 |
| | 300 | -44 | -34 | -24 | -14 | -4 | 6 | 16 | 26 | 36 | 46 | 56 | 60 | 60 |
| | 400 | -42 | -32 | -22 | -12 | -2 | 8 | 18 | 28 | 38 | 48 | 58 | 60 | 60 |
| | 500 | -40 | -30 | -20 | -10 | 0 | 10 | 20 | 30 | 40 | 50 | 60 | 60 | 60 |
| | 600 | -38 | -28 | -18 | -8 | 2 | 12 | 22 | 32 | 42 | 52 | 60 | 60 | 60 |

S2

| MIDDLE ENGINE (PORT-DIRECTION PIVOTING) | | NEIGHBORING-ENGINE ACTUAL PIVOTING ANGLE (deg) | | | | | | | | | | | | |
|---|---|---|---|---|---|---|---|---|---|---|---|---|---|---|
| | | -60 | -50 | -40 | -30 | -20 | -10 | 0 | 10 | 20 | 30 | 40 | 50 | 60 |
| SWIVEL CENTER DISTANCE (mm) | 100 | -60 | -60 | -50 | -40 | -30 | -20 | -10 | 0 | 10 | 20 | 30 | 40 | 50 |
| | 200 | -60 | -60 | -54 | -44 | -34 | -24 | -14 | -4 | 6 | 16 | 26 | 36 | 46 |
| | 300 | -60 | -60 | -56 | -46 | -36 | -26 | -16 | -6 | 4 | 14 | 24 | 34 | 44 |
| | 400 | -60 | -60 | -58 | -48 | -38 | -28 | -18 | -8 | 2 | 12 | 22 | 32 | 42 |
| | 500 | -60 | -60 | -60 | -50 | -40 | -30 | -20 | -10 | 0 | 10 | 20 | 30 | 40 |
| | 600 | -60 | -60 | -60 | -52 | -42 | -32 | -22 | -12 | -2 | 8 | 18 | 28 | 38 |

VESSEL STEERING SYSTEM

BACKGROUND OF THE INVENTION

1. Field of the Invention

The present invention relates to a vessel steering system in which steering is performed by pivoting a propulsion means, such as an outboard engine or a stern drive system, on a swivel shaft.

2. Description of the Related Art

To date, there has been proposed a technology in which, as a steering apparatus for a small vessel or the like equipped with an outboard engine at the stern, the propulsion direction of the vessel is controlled and the vessel is steered by pivoting the outboard engine counterclockwise or clockwise on a swivel shaft (for example, Japanese Patent No. 2734041). A conventional apparatus disclosed in Japanese Patent No. 2734041 is a so-called multi-engine steering apparatus in which two outboard engines provided at the stern are operated in conjunction with each other so that steering is performed; the outboard engines are coupled with a differential lever by the respective tie rods, and the differential lever is pivoted through the operation of the steering wheel by the intermediary of a steering cable, so that the two outboard engines are pivoted in the same direction on the respective swivel shafts in conjunction with each other. In the case of the conventional vessel steering system disclosed in Japanese Patent No. 2734041, as an actuator for pivoting an outboard engine in response to the operation of a steering wheel, there can be utilized a mechanism in which a hydraulic cylinder is adopted.

In addition, to date, in a vessel steering system, there has been proposed a technology in which, by utilizing an electric motor, an outboard engine is pivoted on a swivel shaft so that a vessel is steered (for example, refer to Japanese Patent No. 2959044). A conventional apparatus disclosed in Japanese Patent No. 2959044 is provided with an electric actuator for pivoting a single outboard engine on a swivel shaft, a steering wheel sensor for detecting the pivoting angle and the pivoting direction of a steering wheel, and a controller for controlling the electric actuator based on an output signal from the steering wheel sensor. In the case of the conventional vessel steering system disclosed in Japanese Patent No. 2959044, the steering wheel and the electric actuator for driving the outboard engine are connected with each other by the intermediary of a cable in an electric manner only.

Moreover, to date, in a vessel equipped with a plurality of propulsion units, there has been proposed a multi-engine steering apparatus in which the respective propulsion directions of the plurality of propulsion units are controlled in such a way as to be different in angle from one another so that the vessel can travel in a lateral direction or the like through the propulsion force produced by the combination of the propulsion-direction vectors of the propulsion units (for example, refer to Japanese Patent Application Laid-Open No. 2000-313398). A conventional apparatus disclosed in Japanese Patent Application Laid-Open No. 2000-313398 is provided with an operational drive unit for making each propulsion unit perform steering operation, a shift drive unit for driving each propulsion unit to any one of shift positions, a single operation stick to be manipulated in an arbitrary direction with respect to a neutral position, and a control unit for controlling the respective motors of the drive units based on a signal corresponding to the operation position of the operation stick.

As described above, in the conventional multi-engine steering apparatus disclosed in Japanese Patent No. 2734041, the actuator for pivoting an outboard engine can be formed of a hydraulic cylinder. However, in the case where a hydraulic cylinder is utilized, there has been a problem that there is required a space, around the steering apparatus, where hydraulic tubes for the hydraulic cylinder are arranged and the structure becomes complex.

The conventional multi-engine steering apparatus disclosed in Japanese Patent Application Laid-Open No. 2000-313398 is configured in such a way that the respective steering angles of the propulsion units can independently and freely be controlled; therefore, there has been a problem that the respective driving bodies forming the propulsion units may interfere with one another, whereby the actuator fails or damage to the driving body is caused.

The angle at which the respective driving bodies of the propulsion units start to interfere with one another depends on the size, the shape, the mounting position, and the like of an outboard engine or the like forming the propulsion unit. Therefore, in order to prevent the foregoing interference, it is required to adjust the mounting position of each propulsion unit and the control range of the steering angle, for each type of the propulsion unit such as an outboard engine or each time the propulsion unit is mounted on a vessel. Provided it is impossible to adjust the mounting position and the steering angle of each propulsion unit each time the propulsion unit is mounted on a vessel, a vessel whose stern has a broad overall width is required when the propulsion units are arranged in such a way that the respective driving bodies of the propulsion units never interfere with one another.

In the case of the conventional multi-engine steering apparatus disclosed in Japanese Patent No. 2734041, because of its structure, the respective driving bodies of the outboard engines do not interfere with one another; however, in the case of the conventional apparatus disclosed in Japanese Patent Application Laid-Open No. 2000-313398, the propulsion units cannot be coupled with one another by use of a link mechanism such as the tie rod in the conventional apparatus disclosed in Japanese Patent No. 734041.

SUMMARY OF THE INVENTION

The present invention has been implemented in order to solve the foregoing problems in a conventional vessel steering system; the objective thereof is to provide a vessel steering system in which a propulsion means can pivot without interfering with another propulsion means or the like.

A vessel steering system according to the present invention is configured in such a way that a propulsion means provided on a vessel body is pivoted on a swivel shaft so that steering is performed; the vessel steering system includes a control unit that calculates a control pivoting angle for pivoting the propulsion means based on a steering angle obtained through steering manipulation by an operator; and a pivoting apparatus that pivots the propulsion means based on the control pivoting angle calculated by the control unit. The vessel steering system is characterized in that, based on actual-state recognition of at least one of the type of the vessel, the type of the propulsion means, an actual pivoting angle of a neighboring propulsion means that is close to the propulsion means when a plurality of propulsion means is provided, the distance between the swivel shaft of a reference propulsion means and the swivel shaft of a neighboring propulsion means thereof at a time when a plurality of propulsion means is provided, and the mounting position of the propulsion means on the vessel, the control unit selects a pivoting limit angle for limiting the pivoting of the propulsion means, and controls the pivoting apparatus in such a way that the propulsion means does not pivot by more than the selected pivoting limit angle.

In the present invention, the propulsion means denotes a means, such as an outboard engine or a stern drive system, for propelling a vessel, and includes not only a screw type but also a waterjet type.

In the vessel steering system according to the present invention, based on actual-state recognition of at least one of the type of the vessel, the type of the propulsion means, an actual pivoting angle of a neighboring propulsion means that is close to the propulsion means when a plurality of propulsion means is provided, the distance between the swivel shaft of a reference propulsion means and the swivel shaft of a neighboring propulsion means thereof at a time when a plurality of propulsion means is provided, and the mounting position of the propulsion means on the vessel, the control unit selects a pivoting limit angle for limiting the pivoting of the propulsion means, and controls the pivoting apparatus in such a way that the propulsion means does not pivot by more than the selected pivoting limit angle. As a result, the pivoting limit angle can variably be set in accordance with the actual state of the vessel or the propulsion means; therefore, there is demonstrated an effect that the propulsion means can be pivoted without interfering with another propulsion means, another structure, or the like.

The foregoing and other object, features, aspects, and advantages of the present invention will become more apparent from the following detailed description of the present invention when taken in conjunction with the accompanying drawings.

DETAILED DESCRIPTION OF THE PREFERRED EMBODIMENTS

Embodiment 1

Figure 1:
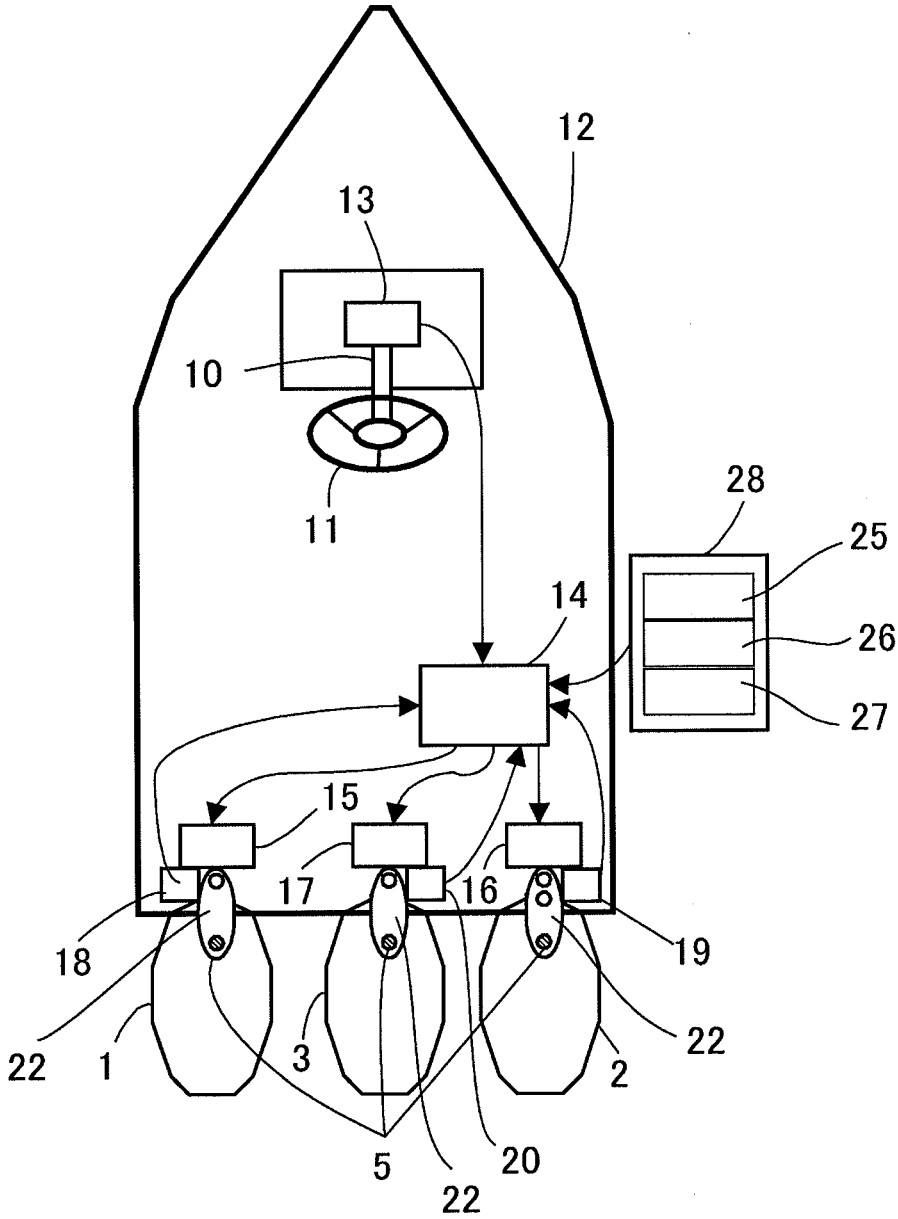
FIG. 1 is a configuration diagram of a vessel steering system according to Embodiment 1 of the present invention.

FIG. 1 is a configuration diagram of a vessel steering system according to Embodiment 1 of the present invention. A vessel steering system illustrated in FIG. 1 is illustrated as an example of three-engine system configured with three outboard engines. In FIG. 1, in a vessel body 12, there are provided a port outboard engine 1 mounted on the port stern, a starboard outboard engine 2 mounted on the starboard stern, and a middle outboard engine 3 mounted at a stern portion between the port outboard engine 1 and the starboard outboard engine 2. The port outboard engine 1, the starboard outboard engine 2, and the middle outboard engine 3 are configured in the same manner; they configure the propulsion system of a vessel. In addition, the respective outboard engines may not be configured in the same manner; for example, they may be different from one another in the engine capacity.

The port outboard engine 1, the starboard outboard engine 2, and the middle outboard engine 3 are each provided at the stern of the vessel body 12 in such a way that each of them can freely pivot on a swivel shaft 5, which is perpendicularly provided, in the port direction (clockwise) and in the starboard direction (counterclockwise). A port pivoting apparatus 15 makes the swivel shaft 5 pivot by the intermediary of a steering arm 22 so as to pivot the port outboard engine 1 on the swivel shaft 5. A starboard pivoting apparatus 16 makes the swivel shaft 5 pivot by the intermediary of the steering arm 22 so as to pivot the starboard outboard engine 2 on the swivel shaft 5. A middle pivoting apparatus 17 makes the swivel shaft 5 pivot by the intermediary of the steering arm 22 so as to pivot the middle outboard engine 3 on the swivel shaft 5.

A port pivoting angle detection sensor 18 detects the pivoting angle of the port outboard engine 1 with respect to the swivel shaft 5, generates a port pivoting angle signal corresponding to the detected pivoting angle, and inputs the port pivoting angle signal to a control unit 14. A starboard pivoting angle detection sensor 19 detects the pivoting angle of the starboard outboard engine 2 with respect to the swivel shaft 5, generates a starboard pivoting angle signal corresponding to the detected pivoting angle, and inputs the starboard pivoting angle signal to the control unit 14. A middle pivoting angle detection sensor 20 detects the pivoting angle of the middle outboard engine 3 with respect to the swivel shaft 5, generates a middle pivoting angle signal corresponding to the detected pivoting angle, and inputs the middle pivoting angle signal to the control unit 14.

A steering angle detection means 13 detects, by the intermediary of a steering column 10, the steering angle of a steering wheel 11 to be manipulated by an operator, generates a steering angle signal corresponding to the detected steering angle, and inputs the steering angle signal to the control unit 14. The control unit 14 receives a signal from an external tool 28 provided with a pivoting limit angle characteristic selection means 25, a pivoting limit angle characteristic downloading means 26, and a swivel center distance instruction means 27. In addition, the details of the external tool 28 will be explained later.

Figure 2:
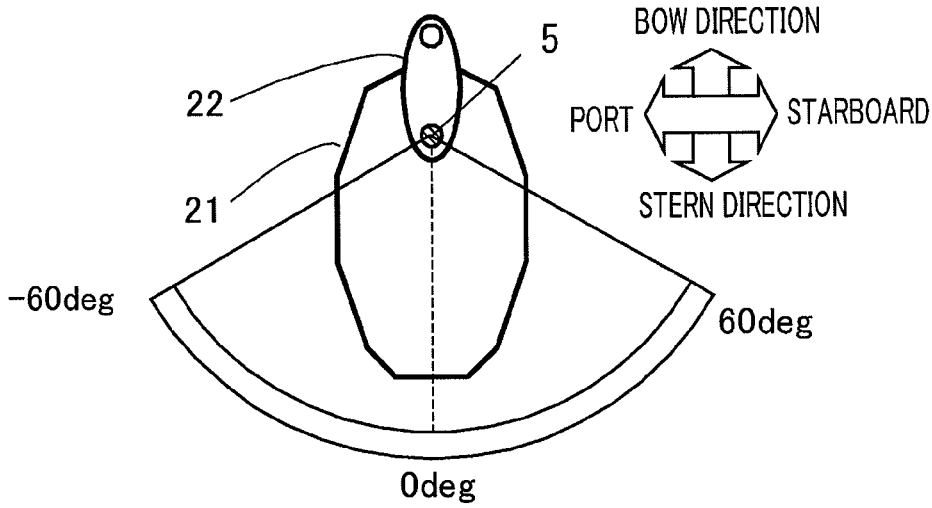
FIG. 2 is an explanatory diagram representing the relationship between the pivoting direction and the pivoting angle of an outboard engine in a vessel steering system according to Embodiment 1 of the present invention.

FIG. 2 is an explanatory diagram representing the relationship between the pivoting direction and the pivoting angle of an outboard engine in a vessel steering system according to Embodiment 1 of the present invention. As represented in FIG. 2, with regard to the relationship between the pivoting direction and the pivoting angle, such as the target pivoting angle, the control pivoting angle, the pivoting angle limit characteristic, actual pivoting angle, or the like, which will be described later, the starboard-direction pivoting of an outboard engine 21 with respect to the swivel 5 is represented as positive-direction pivoting, and the port-direction pivoting of the outboard engine 21 with respect to the swivel 5 is represented as negative-direction pivoting. The outboard engine 21 is configured in such a way as to pivot within the range of −60 [deg] to 60 [deg] unless limitation through a pivoting limit angle, described later, is given. The foregoing configuration applies also to each of the port outboard engine 1, the starboard outboard engine 2, and the middle outboard engine 3.

Figure 3:
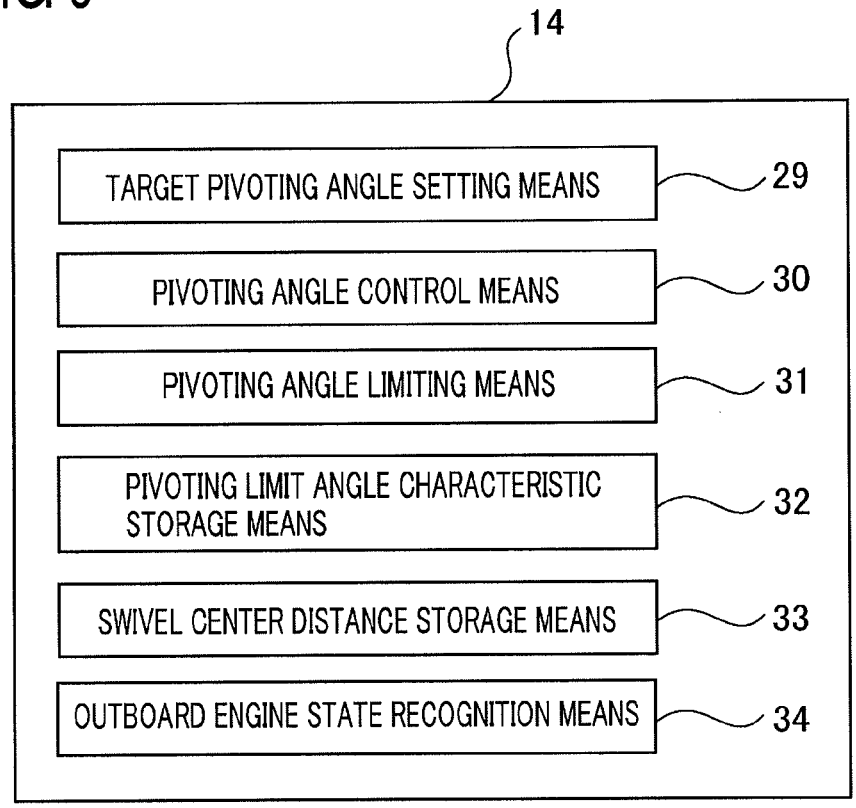
FIG. 3 is a block diagram representing the configuration of a control unit in a vessel steering system according to Embodiment 1 of the present invention.

Next, the configuration of the control unit 14 will be explained. FIG. 3 is a block diagram representing the configuration of a control unit in a vessel steering system according to Embodiment 1 of the present invention. In FIG. 3, the control unit 14 is provided with a target pivoting angle setting means 29, a pivoting angle control means 30, a pivoting angle limiting means 31, a pivoting limit angle characteristic storage means 32, a swivel center distance storage means 33, and an outboard engine state recognition means 34.

Based on the steering angle signal inputted from the steering angle detection means 13, the target pivoting angle setting means 29 calculates and sets a port target pivoting angle for the port outboard engine 1, a starboard target pivoting angle for the starboard outboard engine 2, and a middle target pivoting angle for the middle outboard engine 3.

The pivoting angle control means 30 calculates a control pivoting angle for the port outboard engine 1 based on the pivoting angle of the port outboard engine 1 detected by the port pivoting angle detection sensor 18 and the port target pivoting angle; the pivoting angle control means 30 calculates a control pivoting angle for the starboard outboard engine 2 based on the pivoting angle of the starboard outboard engine 2 detected by the starboard pivoting angle detection sensor 19 and the starboard target pivoting angle; furthermore, the pivoting angle control means 30 calculates a control pivoting angle for the middle outboard engine 3 based on the pivoting angle of the middle outboard engine 3 detected by the middle pivoting angle detection sensor 20 and the middle target pivoting angle.

Based on a pivoting limit angle characteristic map, described later, read from the pivoting limit angle characteristic storage means 32, the actual pivoting angle of a neighboring engine, and the swivel center distance, between the neighboring engines, read from the swivel center distance storage means 33, the pivoting angle limiting means 31 calculates the pivoting limit angle for limiting the pivoting angle of the port outboard engine 1, the pivoting limit angle for limiting the pivoting angle of the starboard outboard engine 2, and the pivoting limit angle for limiting the pivoting angle of the middle outboard engine 3; based on the control pivoting angle for the port outboard engine 1, the control pivoting angle for the starboard outboard engine 2, and the control pivoting angle for the middle outboard engine 3, that are limited by the respective calculated pivoting limit angles, the pivoting angle limiting means 31 drives the port pivoting apparatus 15, the starboard pivoting apparatus 16, and the middle pivoting apparatus 17, so that the corresponding port outboard engine 1, starboard outboard engine 2, and middle outboard engine 3 are pivoted.

The pivoting limit angle characteristic storage means 32 stores a pivoting limit angle characteristic map, described later. The swivel center distance storage means 33 stores the distance between the swivel shafts 5 of the neighboring outboard engines in accordance with the number of the mounted outboard engines. The outboard engine state recognition means 34 recognizes the number of the mounted outboard engines and the state of the mounting position (the port position, the starboard position, the middle position, or the like), on the vessel body, of each of the outboard engines.

Figure 4:
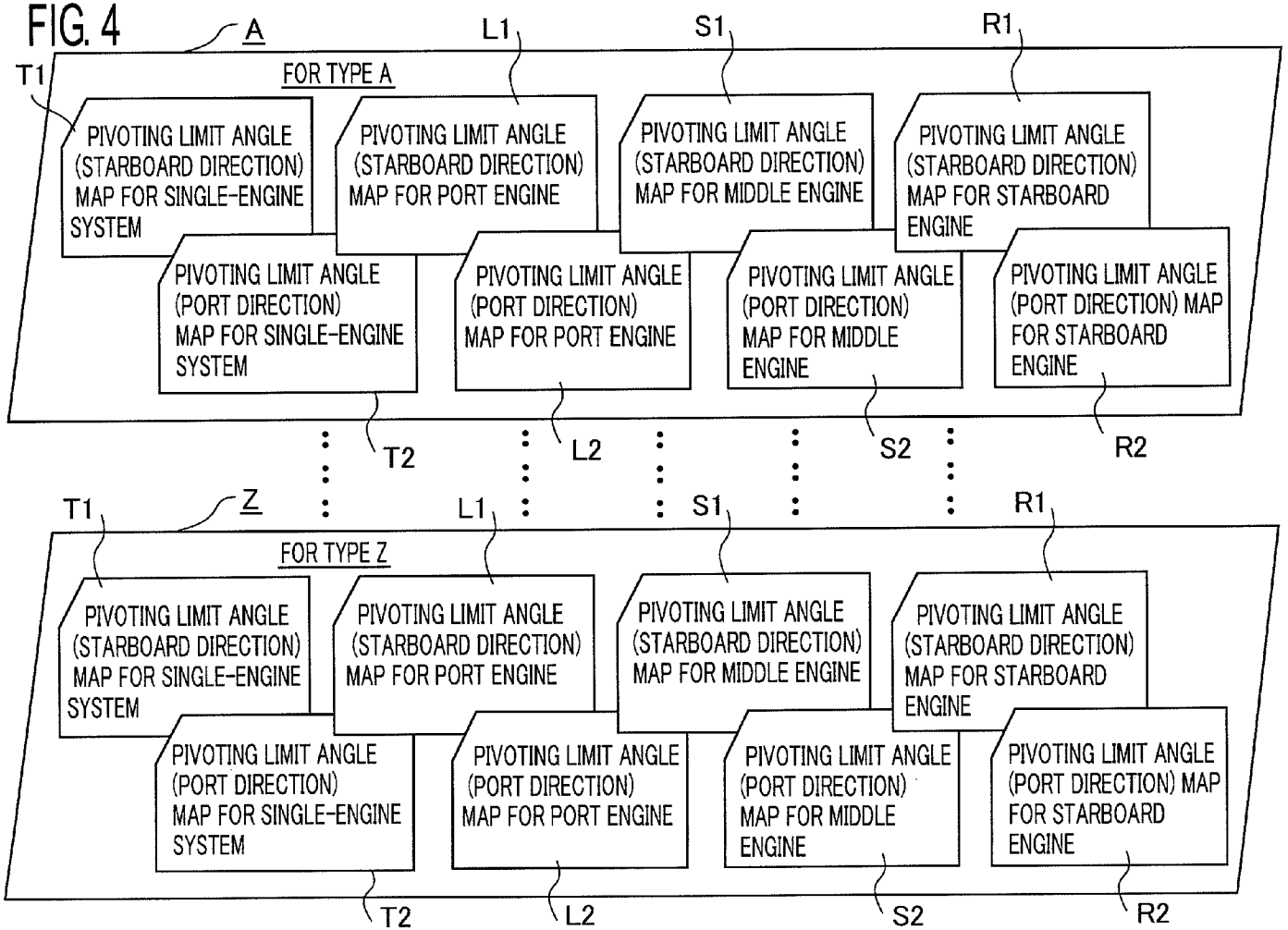
FIG. 4 is an explanatory diagram representing the configuration of a pivoting limit angle characteristic map stored in a pivoting limit angle characteristic storage means in a vessel steering system according to Embodiment 1 of the present invention.

Next, there will be explained the configuration of the pivoting limit angle characteristic map stored in the pivoting limit angle characteristic storage means 32. FIG. 4 is an explanatory diagram representing the configuration of the pivoting limit angle characteristic map stored in the pivoting limit angle characteristic storage means. In FIG. 4, a pivoting limit angle characteristic package A is set for the vessel type A; a pivoting limit angle characteristic package Z is set for the vessel type Z. Although, in practice, an arbitrary number of pivoting limit angle characteristic packages corresponding to any anticipated vessel types are stored in the pivoting limit angle characteristic storage means 32, there are represented, in FIG. 4, only the pivoting limit angle characteristic map A and the pivoting limit angle characteristic package map Z among them, as examples.

In addition, the pivoting limit angle characteristic package to be stored in the pivoting limit angle characteristic storage means 32 may be set corresponding to each of the outboard engine types or each of the combinations of the vessel types and the outboard engine types, instead of being set corresponding to each of the vessel types.

The pivoting limit angle characteristic package A and the pivoting limit angle characteristic package Z are each provided with a pair of maps for the port outboard engine 1 including a pivoting limit angle (starboard direction) port engine map L1 and a pivoting limit angle (port direction) port engine map L2, a pair of maps for the starboard outboard engine 2 including a pivoting limit angle (starboard direction) starboard engine map R1 and a pivoting limit angle (port direction) starboard engine map R2, a pair of maps for the middle outboard engine 3 including a pivoting limit angle (starboard direction) middle engine map S1 and a pivoting limit angle (port direction) middle engine map S2, and a pair of maps for a single-engine system including a pivoting limit angle (starboard direction) single-engine map T1 and a pivoting limit angle (port direction) single-engine map T2.

In other words, each of the pivoting limit angle characteristic packages A and Z has a pair of a pivoting limit angle map utilized in starboard-direction pivoting and a pivoting limit angle map utilized in port-direction pivoting; the foregoing pair is provided in each of the single-engine system, the port outboard engine, the middle outboard engine, and the starboard outboard engine. Accordingly, the pivoting limit angle characteristic package corresponding to a single vessel type has, as a whole, eight kinds of pivoting limit angle characteristic maps, as one package.

Next, the eight kinds of pivoting limit angle characteristic maps will be explained one by one. Each of the pivoting limit angle characteristic maps is formed of a three-dimensional map in which the X axis denotes the neighboring-engine actual pivoting angle, the Y axis denotes the pivoting limit angle, and the Z axis denotes the swivel center distance.

Figures 5, 6:
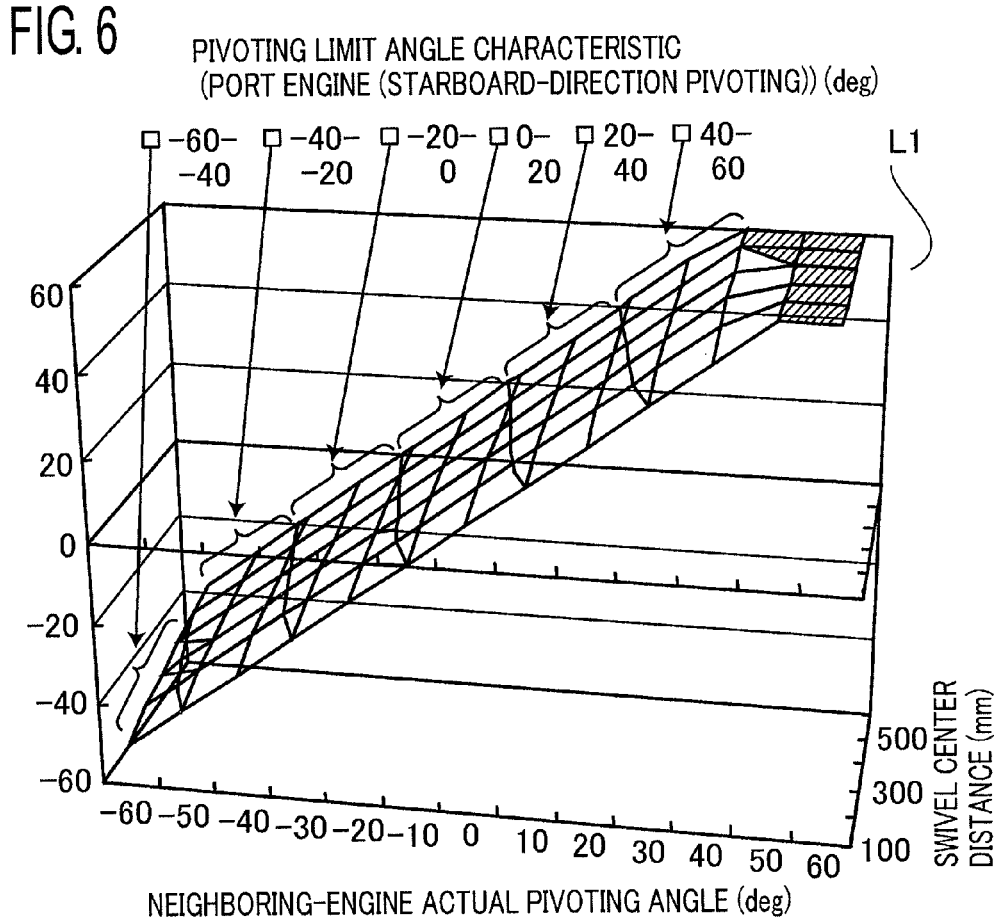
FIG. 5 is a table representing the contents of a pivoting limit angle (starboard direction) port engine map in a vessel steering system according to Embodiment 1 of the present invention.
FIG. 6 is a graph representing the contents of a pivoting limit angle (starboard direction) port engine map in a vessel steering system according to Embodiment 1 of the present invention.

Next, a pair of pivoting limit angle characteristic maps that are utilized for the port outboard engine 1 will be explained. FIG. 5 is a table representing the contents of the pivoting limit angle (starboard direction) port engine map L1, which is one of a pair of pivoting limit angle characteristic maps utilized for the port outboard engine 1. FIG. 6 is a graph representing the contents of the pivoting limit angle (starboard direction) port engine map L1.

In FIGS. 5 and 6, on the X axis, i.e., the neighboring-engine actual pivoting angle, the actual pivoting angle of the neighboring engine of the port outboard engine 1, i.e., the middle outboard engine 3 is set from −60 [deg] to 60 [deg] in steps of 10 [deg]; on the Z axis, i.e., the swivel center distance, the distance between the swivel shaft 5 of the port outboard engine 1 and the swivel shaft 5 of the middle outboard engine 3 is set from 100 [mm] to 600 [mm] in steps of 100 [mm].

On the Y axis, the pivoting limit angle [deg] is set based on the value of the neighboring-engine actual pivoting angle on the X axis and the value of the swivel center distance on the Z axis. The pivoting limit angle on the Y axis is an angle for limiting the starboard-direction pivoting angle of the port outboard engine 1 in order to make the port outboard engine 1 pivot in the starboard direction within a range where the pivoting of the port outboard engine 1 does not interfere with the pivoting of the middle outboard engine 3.

For example, in FIGS. 5 and 6, in the case where the distance between the swivels 5 of the port outboard engine 1 and the middle outboard engine 3 is 300 [mm] and the neighboring-engine actual pivoting angle, i.e., the actual pivoting angle of the middle outboard engine 3 is 10 [deg], the starboard-direction pivoting limit angle of the port outboard engine 1 is 26 [deg]; thus, the port outboard engine 1 cannot pivot on the swivel shaft 5 by more than 26 [deg] in the starboard direction.

Figures 7, 8:
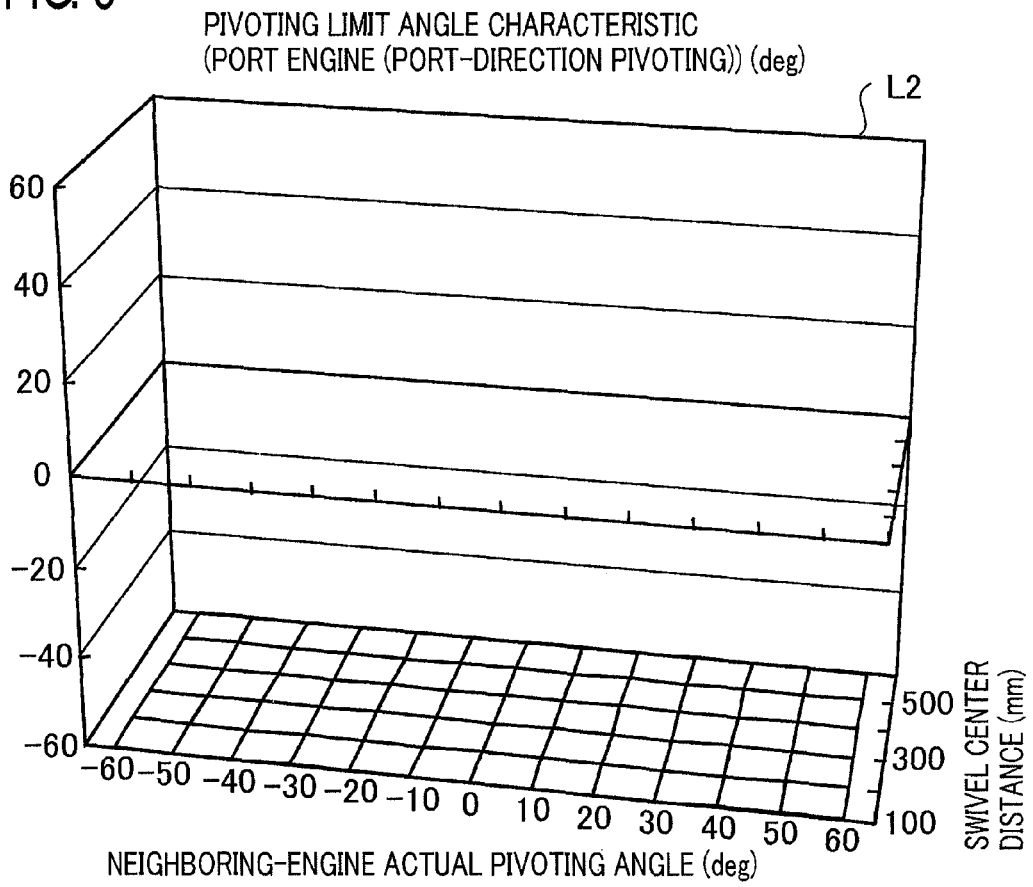
FIG. 7 is a table representing the contents of a pivoting limit angle (port direction) port engine map in a vessel steering system according to Embodiment 1 of the present invention.
FIG. 8 is a graph representing the contents of a pivoting limit angle (port direction) port engine map in a vessel steering system according to Embodiment 1 of the present invention.

FIG. 7 is a table representing the contents of the pivoting limit angle (port direction) port engine map L2, which is the other one of a pair of pivoting limit angle characteristic maps utilized for the port outboard engine 1. FIG. 8 is a graph representing the contents of the pivoting limit angle (port direction) port engine map L2. In FIGS. 7 and 8, on the X axis, i.e., the neighboring-engine actual pivoting angle, the actual pivoting angle of the neighboring engine of the port outboard engine 1, i.e., the middle outboard engine 3 is set from −60 [deg] to 60 [deg] in steps of 10 [deg]; on the Z axis, i.e., the swivel center distance, the distance between the swivel shaft 5 of the port outboard engine 1 and the swivel shaft 5 of the middle outboard engine 3 is set from 100 [mm] to 600 [mm] in steps of 100 [mm].

On the Y axis, the pivoting limit angle [deg] is set based on the value of the neighboring-engine actual pivoting angle on the X axis and the value of the swivel center distance on the Z axis. The pivoting limit angle on the Y axis is an angle for limiting the port-direction pivoting angle of the port outboard engine 1 in order to make the port outboard engine 1 pivot in the port direction within a range where the pivoting of the port outboard engine 1 does not interfere with the pivoting of the middle outboard engine 3.

As is clear from FIGS. 7 and 8, the middle outboard engine 3, which is a neighboring engine, does not interfere with the port-direction pivoting of the port outboard engine 1; therefore, regardless of the values of the neighboring-engine actual pivoting angle and the swivel center distance, the port-direction pivoting limit angle is set to −60 [deg], which is the maximum port direction pivoting angle.

Figures 9, 10:
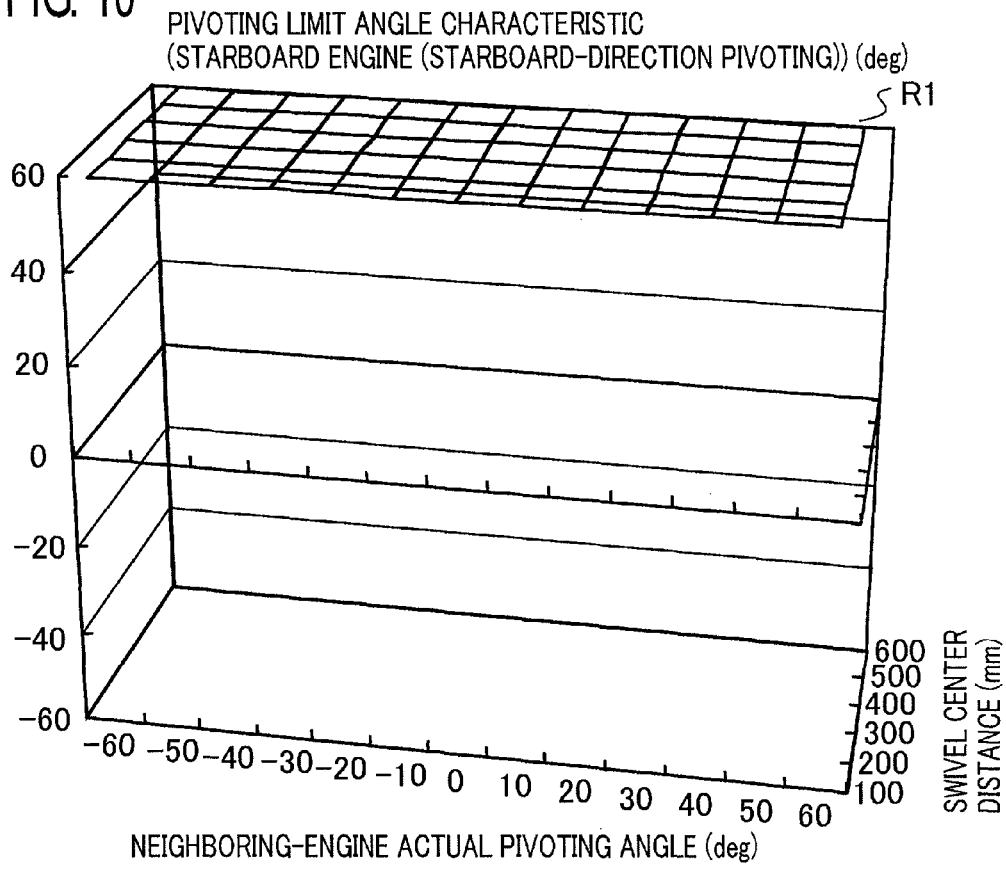
FIG. 9 is a table representing the contents of a pivoting limit angle (starboard direction) starboard engine map in a vessel steering system according to Embodiment 1 of the present invention.
FIG. 10 is a graph representing the contents of a pivoting limit angle (starboard direction) starboard engine map in a vessel steering system according to Embodiment 1 of the present invention.

Next, there will be explained a pair of pivoting limit angle characteristic maps that is utilized for the starboard outboard engine 2. FIG. 9 is a table representing the contents of the pivoting limit angle (starboard direction) starboard engine map R1, which is one of a pair of pivoting limit angle characteristic maps utilized for the starboard outboard engine 2. FIG. 10 is a graph representing the contents of the pivoting limit angle (starboard direction) starboard engine map R1. In FIGS. 9 and 10, on the X axis, i.e., the neighboring-engine actual pivoting angle, the actual pivoting angle of the neighboring engine of the starboard outboard engine 2, i.e., the middle outboard engine 3 is set from −60 [deg] to 60 [deg] in steps of 10 [deg]; on the Z axis, i.e., the swivel center distance, the distance between the swivel shaft 5 of the starboard outboard engine 2 and the swivel shaft 5 of the middle outboard engine 3 is set from 100 [mm] to 600 [mm] in steps of 100 [mm].

On the Y axis, the pivoting limit angle [deg] is set based on the value of the neighboring-engine actual pivoting angle on the X axis and the value of the swivel center distance on the Z axis. The pivoting limit angle on the Y axis is an angle for limiting the starboard-direction pivoting angle of the starboard outboard engine 2 in order to make the starboard outboard engine 2 pivot in the starboard direction within a range where the pivoting of the starboard outboard engine 2 does not interfere with the pivoting of the middle outboard engine 3.

As is clear from FIGS. 9 and 10, the middle outboard engine 3, which is a neighboring engine, does not interfere with the starboard-direction pivoting of the starboard outboard engine 2; therefore, regardless of the values of the neighboring-engine actual pivoting angle and the swivel center distance, the starboard-direction pivoting limit angle is set to 60 [deg], which is the maximum starboard direction pivoting angle.

Figures 11, 12:
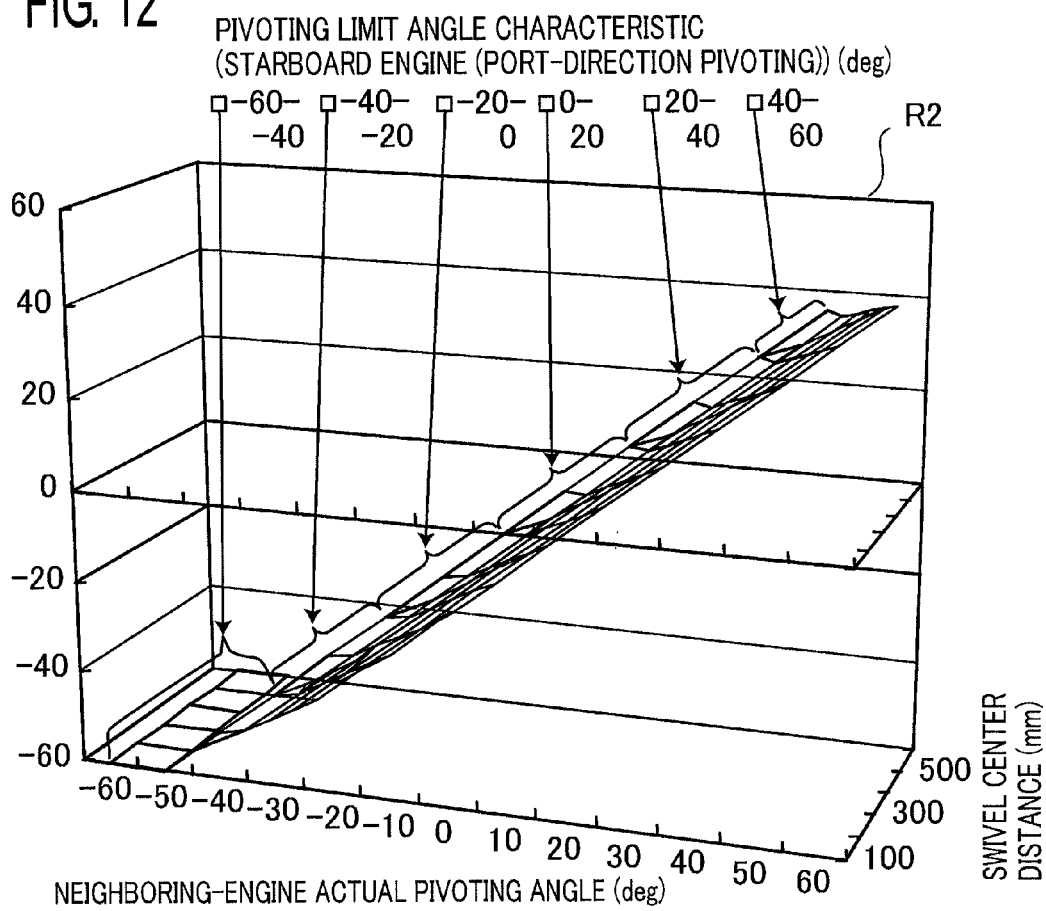
FIG. 11 is a table representing the contents of a pivoting limit angle (port direction) starboard engine map in a vessel steering system according to Embodiment 1 of the present invention.
FIG. 12 is a graph representing the contents of a pivoting limit angle (port direction) starboard engine map in a vessel steering system according to Embodiment 1 of the present invention.

FIG. 11 is a table representing the contents of the pivoting limit angle (port direction) starboard engine map R2, which is the other one of a pair of pivoting limit angle characteristic maps utilized for the starboard outboard engine 2. FIG. 12 is a graph representing the contents of the pivoting limit angle (port direction) starboard engine map R2. In FIGS. 11 and 12, on the X axis, i.e., the neighboring-engine actual pivoting angle, the actual pivoting angle of the neighboring engine of the starboard outboard engine 2, i.e., the middle outboard engine 3 is set from −60 [deg] to 60 [deg] in steps of 10 [deg]; on the Z axis, i.e., the swivel center distance, the distance between the swivel shaft 5 of the starboard outboard engine 2 and the swivel shaft 5 of the middle outboard engine 3 is set from 100 [mm] to 600 [mm] in steps of 100 [mm].

On the Y axis, the pivoting limit angle [deg] is set based on the value of the neighboring-engine actual pivoting angle on the X axis and the value of the swivel center distance on the Z axis. The pivoting limit angle on the Y axis is an angle for limiting the port-direction pivoting angle of the starboard outboard engine 2 in order to make the starboard outboard engine 2 pivot in the port direction within a range where the pivoting of the starboard outboard engine 2 does not interfere with the pivoting of the middle outboard engine 3.

For example, in FIGS. 11 and 12, in the case where the distance between the swivels 5 of the starboard outboard engine 2 and the middle outboard engine 3 is 200 [mm] and the neighboring-engine actual pivoting angle, i.e., the actual pivoting angle of the middle outboard engine 3 is −20 [deg], the pivoting limit angle of the starboard outboard engine 2 is −34 [deg]; thus, the starboard outboard engine 2 cannot pivot on the swivel shaft 5 by more than −34 [deg] in the port direction.

Figures 13, 14:
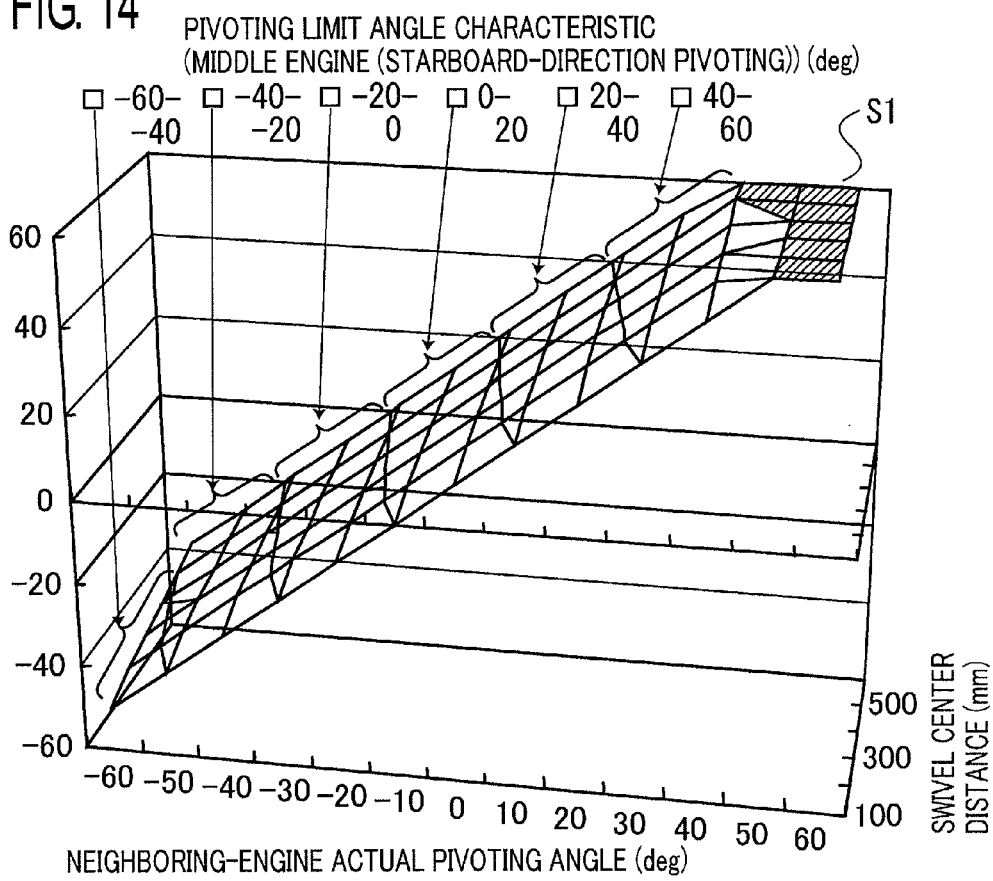
FIG. 13 is a table representing the contents of a pivoting limit angle (starboard direction) middle engine map in a vessel steering system according to Embodiment 1 of the present invention.
FIG. 14 is a graph representing the contents of a pivoting limit angle (starboard direction) middle engine map in a vessel steering system according to Embodiment 1 of the present invention.

Next, there will be explained a pair of pivoting limit angle characteristic maps that is utilized for the middle outboard engine 3. FIG. 13 is a table representing the contents of the pivoting limit angle (starboard direction) middle engine map S1, which is one of a pair of pivoting limit angle characteristic maps utilized for the middle outboard engine 3. FIG. 14 is a graph representing the contents of the pivoting limit angle (starboard direction) middle engine map S1. In FIGS. 13 and 14, on the X axis, i.e., the neighboring-engine actual pivoting angle, the actual pivoting angle of the neighboring engine, which may affects the pivoting of the middle outboard engine 3 when the middle outboard engine 3 pivots in the starboard direction, i.e., the starboard outboard engine 2 is set from −60 [deg] to 60 [deg] in steps of 10 [deg]; on the Z axis, i.e., the swivel center distance, the distance between the swivel shaft 5 of the starboard outboard engine 2 and the swivel shaft 5 of the middle outboard engine 3 is set from 100 [mm] to 600 [mm] in steps of 100 [mm].

On the Y axis, the pivoting limit angle [deg] is set based on the value of the neighboring-engine actual pivoting angle on the X axis and the value of the swivel center distance on the Z axis. The pivoting limit angle on the Y axis is an angle for limiting the starboard-direction pivoting angle of the middle outboard engine 3 in order to make the middle outboard engine 3 pivot in the starboard direction within a range where the pivoting of the middle outboard engine 3 does not interfere with the pivoting of the starboard outboard engine 2.

For example, in FIGS. 13 and 14, in the case where the distance between the swivels 5 of the starboard outboard engine 2 and the middle outboard engine 2 is 300 [mm] and the neighboring-engine actual pivoting angle, i.e., the actual pivoting angle of the starboard outboard engine 2 is 40 [deg], the pivoting limit angle of the middle outboard engine 3 is 56 [deg]; thus, the middle outboard engine 3 cannot pivot on the swivel shaft 5 by more than 56 [deg] in the port direction.

Figures 15, 16:
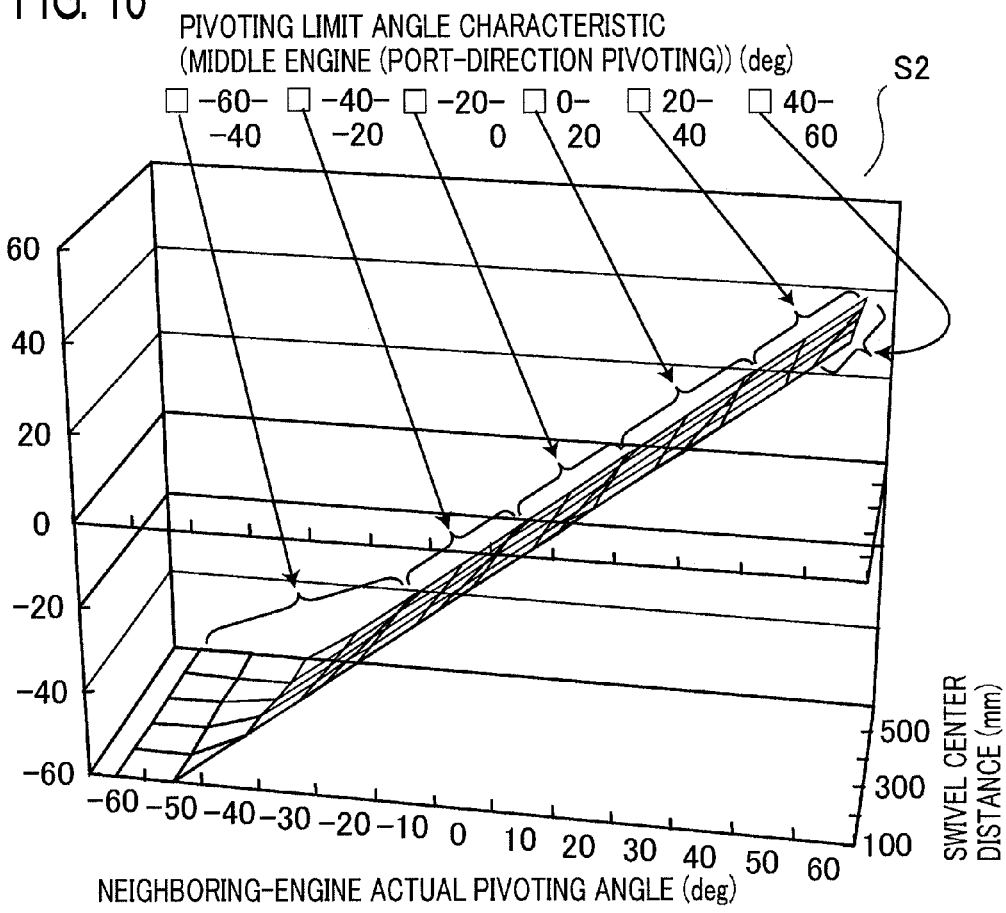
FIG. 15 is a table representing the contents of a pivoting limit angle (port direction) middle engine map in a vessel steering system according to Embodiment 1 of the present invention.
FIG. 16 is a graph representing the contents of a pivoting limit angle (port direction) middle engine map in a vessel steering system according to Embodiment 1 of the present invention.

FIG. 15 is a table representing the contents of the pivoting limit angle (port direction) middle engine map S2, which is the other one of a pair of pivoting limit angle characteristic maps utilized for the middle outboard engine 3. FIG. 16 is a graph representing the contents of the pivoting limit angle (port direction) middle engine map S2. In FIGS. 15 and 16, on the X axis, i.e., the neighboring-engine actual pivoting angle, the actual pivoting angle of the neighboring engine, which may affects the pivoting of the middle outboard engine 3 when the middle outboard engine 3 pivots in the port direction, i.e., the port outboard engine 1 is set from −60 [deg] to 60 [deg] in steps of 10 [deg]. On the Z axis, i.e., the swivel center distance, the distance between the swivel shaft 5 of the port outboard engine 1 and the swivel shaft 5 of the middle outboard engine 3 is set from 100 [mm] to 600 [mm] in steps of 100 [mm].

On the Y axis, the pivoting limit angle [deg] is set based on the value of the neighboring-engine actual pivoting angle on the X axis and the value of the swivel center distance on the Z axis. The pivoting limit angle on the Y axis is an angle for limiting the port-direction pivoting angle of the middle outboard engine 3 in order to make the middle outboard engine 3 pivot in the port direction within a range where the pivoting of the middle outboard engine 3 does not interfere with the pivoting of the port outboard engine 1.

For example, in FIGS. 15 and 16, in the case where the distance between the swivels 5 of the port outboard engine 1 and the middle outboard engine 3 is 600 [mm] and the neighboring-engine actual pivoting angle, i.e., the actual pivoting angle of the starboard outboard engine 2 is −30 [deg], the pivoting limit angle of the middle outboard engine 3 is −52 [deg]. Accordingly, the middle outboard engine 3 cannot pivot on the swivel shaft 5 by more than −52 [deg] in the port direction.

Next, there will be explained the pivoting limit angle (starboard direction) single-engine map T1 and the pivoting limit angle (port direction) single-engine map T2, which form a pair of maps for a single-engine system including. Although these maps are not illustrated, the starboard-direction pivoting limit angle as well as the port-direction pivoting limit angle is set to a maximum pivoting angle that is determined by the kind of a vessel or the type of an outboard engine, because, in the case of a single-engine system, there exists no neighboring outboard engine. For example, the starboard-direction pivoting limit angle and the port-direction pivoting limit angle are set to 60 [deg] and −60 [deg], respectively.

In addition, the value of the pivoting limit angle in the pivoting limit angle (starboard direction) single-engine system map T1, which is one of a pair of maps for a single-engine system, has the same characteristic as the value of the pivoting limit angle in the pivoting limit angle (starboard direction) starboard engine map R1; furthermore, the value of the pivoting limit angle in the pivoting limit angle (port direction) single-engine system map T2, which is the other one of a pair of maps for a single-engine system, has the same characteristic as the value of the pivoting limit angle in the pivoting limit angle (port direction) port engine map L2; thus, it is made possible to utilize these maps. In that case, the storage region for the pivoting limit angle characteristic package can be reduced.

Next, in FIG. 1, the external tool 28 is connected with the control unit 14. The external tool 28 is configured with a note personal computer and the like and includes the pivoting limit angle characteristic selection means 25, the pivoting limit angle characteristic downloading means 26, and the swivel center distance instruction means 27. The external tool 28 and the control unit 14 are connected with each other through serial communication. If a CAN bus is available, the external tool 28 and the control unit 14 may be connected with each other through the CAN bus.

There will be explained the operation of the vessel steering system, configured as described above, according to Embodiment 1 of the present invention. In FIG. 1, for example, an operator of a board builder or a dealer firstly operates the external tool 28 so that a pivoting limit angle characteristic selection instruction command is transmitted from the pivoting limit angle characteristic selection means 25 in the external tool 28 to the control unit 14.

Here, the pivoting limit angle characteristic selection instruction command is, specifically, an instruction as to which package, among pivoting limit angle characteristic packages stored in the pivoting limit angle characteristic storage means 32, is to be selected; the pivoting limit angle characteristic selection instruction command is configured with a numerical value or the like for selecting a certain package among a plurality of pivoting limit angle characteristic packages corresponding to the type of a vessel or an outboard engine.

Figure 17:
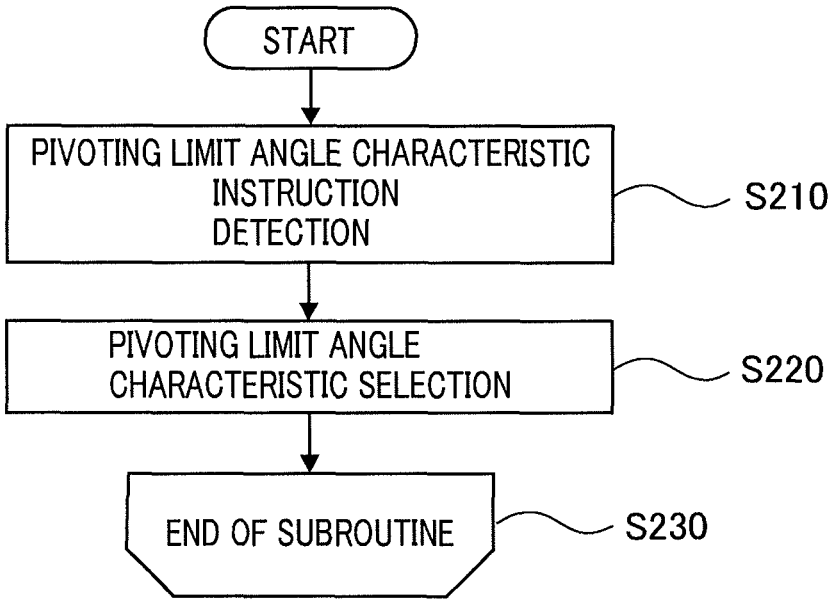
FIG. 17 is a flowchart explaining selection operation for a pivoting limit angle characteristic in a vessel steering system according to Embodiment 1 of the present invention.
Figure 20:
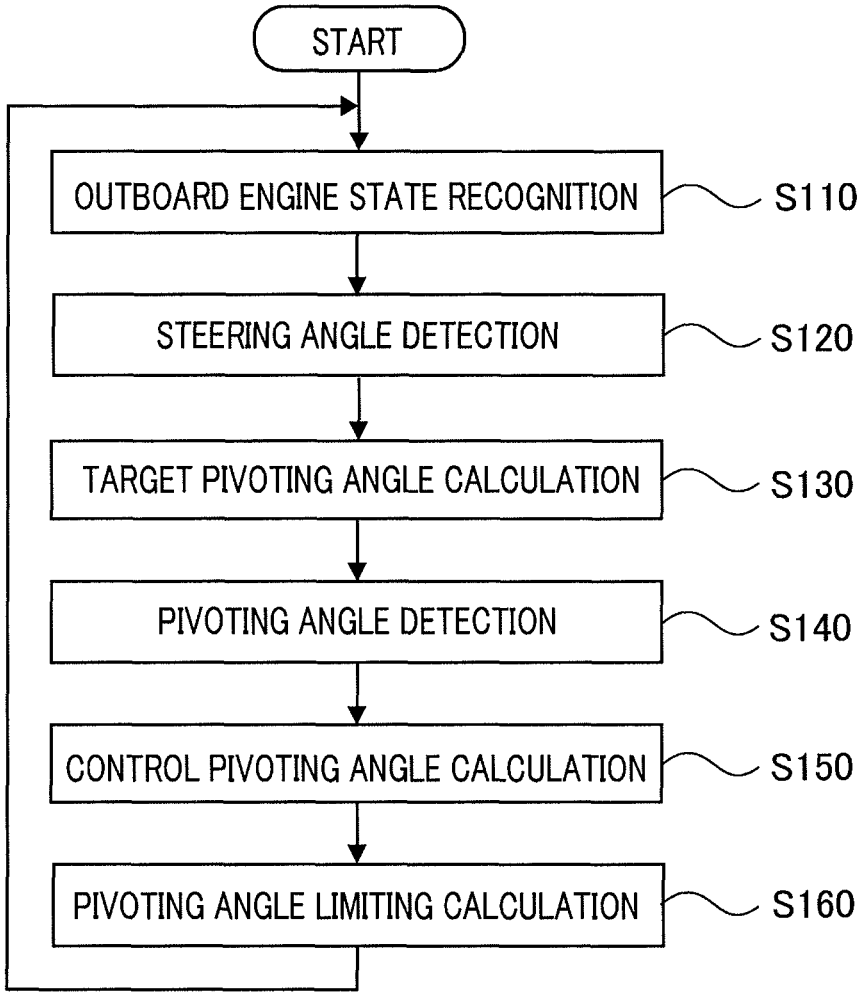
FIG. 20 is a flowchart representing pivoting limit angle calculation operation in a vessel steering system according to Embodiment 1 of the present invention.

FIG. 17 is a flowchart explaining selection operation for a pivoting limit angle characteristic in a vessel steering system according to Embodiment 1 of the present invention. The control unit 14 performs a routine for selecting a pivoting angle limit characteristic represented in FIG. 17 in the case where it receives the pivoting limit angle characteristic selection instruction command from the external tool 28 while initialization processing is performed before a pivoting limit angle calculation routine, described later, represented in FIG. 20 is carried out or while the routine represented in FIG. 20 is carried out.

In the processing routine represented in FIG. 17, at first, the processing in the step S210 is started. For example, when, as the pivoting limit angle characteristic selection instruction command, a numerical value indicating a first pivoting limit angle characteristic package is transmitted from the pivoting limit angle characteristic selection means 25 in the external tool 28 to the control unit 14, the control unit 14 detects the pivoting limit angle characteristic selection instruction in the step S210.

Next, in the step S220, there is selected a pivoting limit angle characteristic package which is stored in a youngest address of the pivoting limit angle characteristic storage means 32, for example, the pivoting limit angle characteristic package A; in the step S230, the pivoting limit angle characteristic selection routine is completed, and then the original processing position is resumed.

In addition, the instruction of selecting the pivoting limit angle characteristic may be performed through mutual information exchange between the control unit 14 and the external tool 28. In other words, specifically, the external tool 28 transmits a command "read all packages stored in the pivoting limit angle characteristic storage means 32" to the control unit 14, and then the control unit 14 transmits a reply "all packages stored in the pivoting limit angle characteristic storage means 32" to the external tool 28.

A type header expressed by a character string, for example, a header "type A" belongs to the transmitted pivoting limit angle characteristic package; the external tool 28 displays the type header on the screen. There can be provided a simple user interface in such a way that a vessel operator, as a user, obtains the pivoting limit angle characteristic package corresponding to the type of the vessel by selecting the displayed type name. The external tool 28 converts the type name selected by the user into the previously read sequence number and gives an instruction to the control unit 14; the control unit 14 selects the pivoting limit angle characteristic package based on the instruction.

Figure 18:
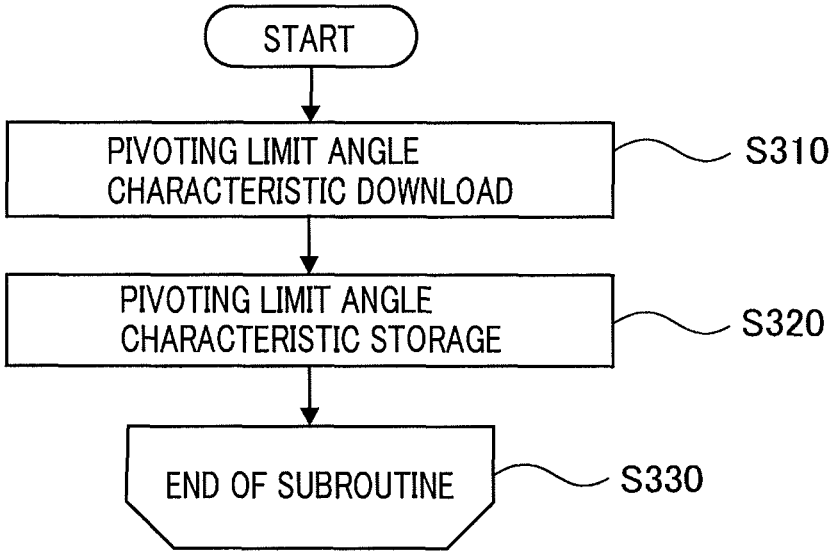
FIG. 18 is a flowchart explaining downloading of a pivoting limit angle characteristic in a vessel steering system according to Embodiment 1 of the present invention.

Next, downloading of a pivoting limit angle characteristic by the control unit 14 will be explained. FIG. 18 is a flowchart explaining downloading of a pivoting limit angle characteristic in a vessel steering system according to Embodiment 1 of the present invention. The control unit 14 performs processing represented in FIG. 18 in the case where it receives a pivoting limit angle characteristic download command from the external tool 28 while initialization processing is performed before processing, described later, represented in FIG. 20 is carried out or while the processing represented in FIG. 20 is carried out.

In the processing routine represented in FIG. 18, at first, the processing in the step S310 is started. In the step S310, when receiving a pivoting limit angle characteristic download command from the pivoting limit angle characteristic downloading means 26 in the external tool 28, the control unit 14 performs downloading of a pivoting limit angle characteristic package.

Here, the pivoting limit angle characteristic download command is, specifically, a command for instructing to rewrite the contents in a predetermined storage section of the control unit 14 to the contents of a designated pivoting limit angle characteristic package or a command for instructing to rewrite the contents of all packages. For example, when, through the external tool 28, a user selects a pivoting limit angle characteristic package, corresponding to a new type of a vessel or an outboard engine, which is held in the external tool 28, the external tool 28 instructs the control unit 14 to download the pivoting limit angle characteristic package corresponding to the new type.

In the case where a vacant package storage region exists in the preliminarily retained pivoting limit angle characteristic storage means 32, the control unit 14 stores the contents of the pivoting limit angle characteristic package for the indicated type in the storage region; in the case where no vacant package storage region exists, the control unit 14 transmits a reply of refusal to the external tool 28. This storage region is formed of a nonvolatile memory.

In addition, processing to be performed after the reply of refusal is not represented in particular; however, there can be conceived, for example, processing in which, when receiving the reply of refusal from the control unit 14, the external tool 28 transmits, to the control unit 14, an erasure command for designating and erasing a specific pivoting limit angle characteristic package, the control unit 14 erases the designated pivoting limit angle characteristic package in response to the erasure command so as to prepare a storage region for storing the pivoting limit angle characteristic package for the indicated type.

Next, in the step S320, the contents of the pivoting limit angle characteristic package downloaded in the step S310 is stored in a vacant package storage region in the pivoting limit angle characteristic storage means 32 of the control unit 14 or in a storage region prepared in response to the erasure command. After that, in the step S330, the pivoting limit angle characteristic download routine is completed; then, the original processing position is resumed.

Figure 19:
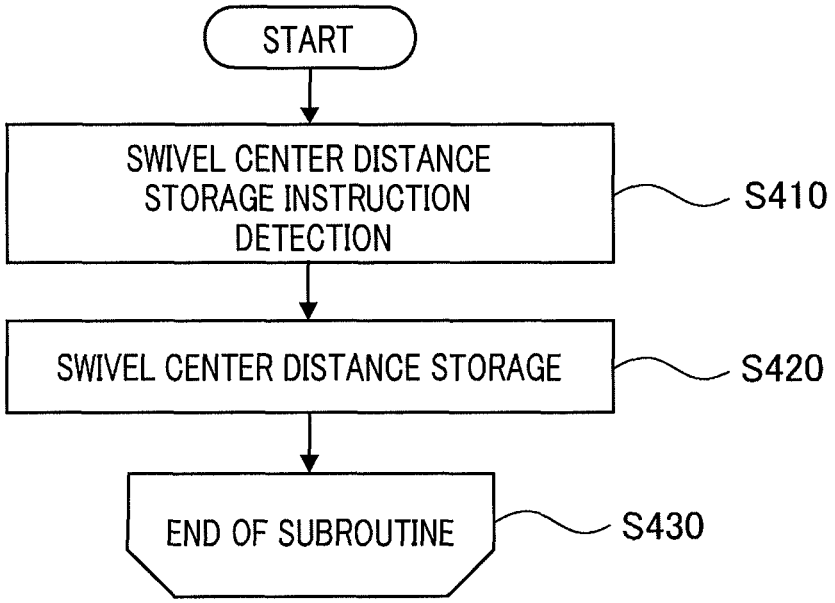
FIG. 19 is a flowchart explaining storing operation for a swivel center distance in a vessel steering system according to Embodiment 1 of the present invention.

Next, storing operation for a swivel center distance by the control unit 14 will be explained. FIG. 19 is a flowchart explaining storing operation for a swivel center distance in a vessel steering system according to Embodiment 1 of the present invention. The control unit 14 performs processing represented in FIG. 19 in the case where it receives a pivoting limit angle characteristic download command from the external tool 28 while initialization processing is performed before processing, described later, represented in FIG. 20 is carried out or while the processing represented in FIG. 20 is carried out.

In the processing routine represented in FIG. 19, at first, the processing in the step S410 is started. In the step S410, the control unit 14 receives a swivel center distance storage command from the swivel center distance instruction means 27 in the external tool 28.

Here, the swivel center distance storage command is, specifically, a numerical value that indicates the distance between the swivel shaft 5 of the x-th engine and the swivel shaft 5 of the y-th engine among the swivel center distances stored in the swivel center distance storage means 33 of the control unit 14. For example, in the case where three outboard engines are mounted, the first value is the distance between the swivel shafts 5 of the port outboard engine 1 and the swivel shaft 5 of the middle outboard engine 3; the second value is the distance between the swivel shaft 5 of the middle outboard engine 3 and the swivel shaft 5 of the starboard outboard engine 2.

In the step S410, the control unit 14 detects the swivel center distance storage command from the external tool 28, and then in the step S420, the control unit 14 actually stores the indicated swivel center distance in a storage region. After that, in the step S430, the swivel center distance storage routine is completed; then, the original processing position is resumed.

Next, pivoting limit angle calculation operation by the control unit 14 will be explained. FIG. 20 is a flowchart representing pivoting limit angle calculation operation in a vessel steering system according to Embodiment 1 of the present invention. The control unit 14 performs a processing routine represented in FIG. 20 every predetermined period. In the processing routine represented in FIG. 20, at first, the processing in the step S110 is started. In FIG. 20, at first, an outboard engine state is recognized in the step S110. Here, the outboard engine state denotes the number of the mounted outboard engines mounted at the stern of the vessel body 12, the respective mounting positions, on the vessel body 12, of the outboard engines (the port position, the starboard position, the middle position, or the like), and the swivel center distances.

When a vessel operator pivots the steering wheel 11 by an arbitrary angle in an arbitrary direction, the steering angle detection means 13 detects, by the intermediary of the steering column 10, the pivoting direction and the pivoting angle of the manipulated steering wheel 11; the steering angle detection means 13 inputs, as a voltage value, a pulse value, or the like, the steering angle signal corresponding to the detection value to the control unit 14. In the step S120, the control unit 14 detects the steering angle signal, based on the input steering angle signal.

Next, in the step S130, based on the steering angle obtained from the detected steering angle signal, the target pivoting angle [deg] for the outboard engine is calculated. As described above, the steering angle signal is configured with a voltage value, a pulse value, or the like corresponding to the pivoting direction and the pivoting angle of the steering wheel 11; therefore, by use of a "steering angle signal vs. target pivoting angle characteristic map" (unillustrated) or the like, there is calculated each of the target pivoting angles, corresponding to the steering angle signal, of the port outboard engine 1, the starboard outboard engine 2, and the middle outboard engine 3.

In addition, in Embodiment 1 of the present invention, the control unit 14 performs calculation of the target pivoting angle; however, in the case where the steering angle detection means 13 is formed of an electronic control unit, the target pivoting angle setting means (including a steering angle detection section and a target pivoting angle calculation section) may be included in the steering angle detection means 13 so that the steering angle detection means 13 performs calculation of the target pivoting angle. In this case, the step S130 is a reception process where the control unit 14 receives the target pivoting angle calculated by the steering angle detection means 13, through CAN communication or the like.

In the step S140, the port pivoting angle detection sensor 18 detects the actual pivoting angle of the port outboard engine 1; the starboard pivoting angle detection sensor 19 detects the actual pivoting angle of the starboard outboard engine 2; the middle pivoting angle detection sensor detects the actual pivoting angle of the middle outboard engine 3.

Next, in the step S150, the control unit 14 calculates the respective control pivoting angles for the port outboard engine 1, the starboard outboard engine 2, and the middle outboard engine 3, based on the respective target pivoting angles, obtained in the step S130, for the port outboard engine 1, the starboard outboard engine 2, and the middle outboard engine 3 and the respective actual pivoting angles, obtained through the pivoting angle sensors 18, 19, and 20, of the port outboard engine 1, the starboard outboard engine 2, and the middle outboard engine 3.

Next, in the step S160, the control unit 14 performs calculation of the pivoting limit angle and puts limitation on the control pivoting angle based on the result of the calculation. In other words, at first, based on the respective mounting positions (the port position, the starboard position, and the middle position) of the outboard engines, on the vessel body 12, which have been obtained from the outboard engine state recognition means 34 in the step S110, a map corresponding to the mounting position of a control-subject outboard engine is selected from the pivoting limit angle characteristic package stored in the control unit in accordance with the processing routine represented in FIG. 18.

Specifically, as described above, in Embodiment 1 of the present invention, the pivoting limit angle characteristic package A is downloaded and stored in a predetermined storage section of the control unit 14; therefore, from the pivoting limit angle characteristic package A, the pivoting limit angle (starboard direction) port engine map L1 and the pivoting limit angle (port direction) port engine map L2, represented in FIG. 4, are selected for the port outboard engine 1; the pivoting limit angle (starboard direction) starboard engine map R1 and the pivoting limit angle (port direction) starboard engine map R2 are selected for the starboard outboard engine 2; and the pivoting limit angle (starboard direction) middle engine map S1 and the pivoting limit angle (port direction) middle engine map S2 are selected for the middle outboard engine 3.

Similarly, based on the mounting position of the control-subject outboard engine obtained from the outboard engine state recognition means 34, the distance between the swivel shafts 5 of the port outboard engine 1 and the middle outboard engine 3 and the distance between the swivel shafts 5 of the starboard outboard engine 2 and the middle outboard engine 3 are selected from the swivel center distances stored in the swivel center distance storage means 33.

Next, by, as parameters, utilizing the respective actual pivoting angles, detected in the step S140, of the port outboard engine 1, the starboard outboard engine 2, and the middle outboard engine 3, and the distance between the swivel shafts 5 of the port outboard engine 1 and the middle outboard engine 3 and the distance between the swivel shafts 5 of the starboard outboard engine 2 and the middle outboard engine 3 selected from the swivel center distances stored in the swivel center distance storage means 33, there is calculated the pivoting limit angle for each of the outboard engines, based on the selected pivoting limit angle characteristic map.

The calculations of respective specific pivoting limit angles based on the pivoting limit angle characteristic maps L1, L2, R1, R2, S1, and S2 have been explained with reference to FIGS. 5 to 16; therefore, explanations therefor will be omitted here.

Based on the pivoting limit angle for each of the outboard engines obtained from the foregoing calculation, the control unit 14 put limitation on the control pivoting angle, obtained in the step S160, for each of the outboard engines. Specifically, with regard to the port outboard engine 1, the starboard outboard engine 2, and the middle outboard engine 3, in the case of pivoting in the starboard direction (0 to 60 [deg]), when the pivoting limit angle (starboard direction) is larger than the control pivoting angle, pivoting in the starboard direction corresponding to the control pivoting angle can be performed without being limited by the pivoting limit angle (starboard direction); when the control pivoting angle is larger than the pivoting limit angle (starboard direction), the control pivoting angle is made to be equal to the pivoting limit angle (starboard direction), whereby pivoting in the starboard direction is limited not to exceed the pivoting limit angle (starboard direction).

In the case of pivoting in the port direction (0 to −60 [deg]), when the control pivoting angle is smaller than the pivoting limit angle (port direction) [the pivoting limit angle (port direction>the control pivoting angle], the control pivoting angle is made to be equal to the pivoting limit angle (port direction) [the control pivoting angle=the pivoting limit angle (port direction], whereby pivoting in the port direction is limited not to exceed the pivoting limit angle (port direction); when the pivoting limit angle (port direction) is smaller than the control pivoting angle [the pivoting limit angle (port direction)<the control pivoting angle], pivoting in the port direction corresponding to the control pivoting angle can be performed without being limited by the pivoting limit angle (port direction).

The processing in the steps S130 to S160 is performed as many times as the number corresponding to the positions of an outboard engine and the number of outboard engines (unillustrated) obtained by the outboard engine state recognition means 34; in the case of Embodiment 1 of the present invention, the vessel steering system includes three outboard engines; because the foregoing processing is performed for each of the port outboard engine 1, the starboard outboard engine 2, the middle outboard engine 3, it is performed three times.

The control commands corresponding to the control pivoting angles, obtained in such a way as described above, for the port outboard engine 1, the starboard outboard engine 2, and the middle outboard engine 3 are inputted from the control unit 14 to the port pivoting apparatus 15, the starboard pivoting apparatus 16, and the middle pivoting apparatus 17, respectively. The port pivoting apparatus 15, the starboard pivoting apparatus 16, and the middle pivoting apparatus 17 that receive the respective control commands from the control unit 14 each drive the steering arm 22 to pivot the swivel shaft 5, based on the control command, so that the port outboard engine 1, the starboard outboard engine 2, and the middle outboard engine 3 are controlled so as to pivot on the swivel shaft 5 in the port direction or in the starboard direction. As a result, the vessel body 12 is steered in accordance with the steering angle of the steering wheel manipulated by a vessel operator.

Embodiment 2

Figure 21:
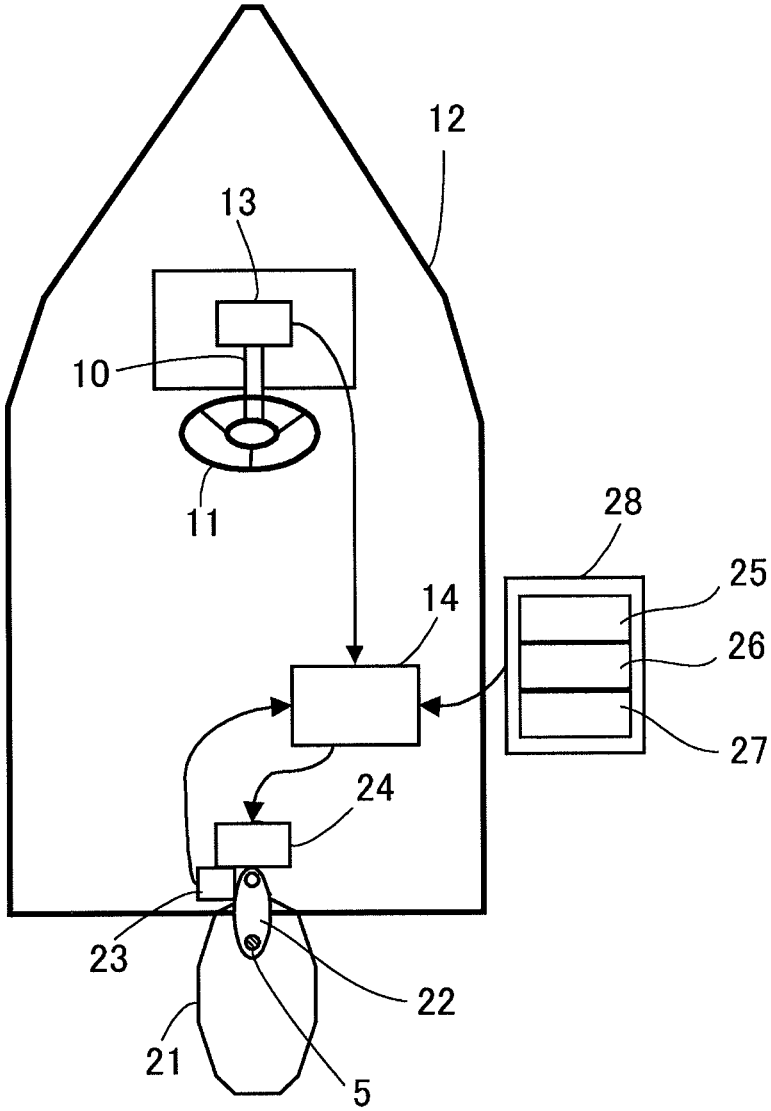
FIG. 21 is a configuration diagram representing a vessel steering system according to Embodiment 2 of the present invention.

FIG. 21 is a configuration diagram representing a vessel steering system according to Embodiment 2 of the present invention. The vessel steering system according to Embodiment 2 corresponds to a so-called single-engine system in which only one outboard engine is provided at the stern of the vessel body 12.

In FIG. 21, an outboard engine 21 is provided at the middle of the stern of the vessel body 12 in such a way that it can freely pivot on the swivel shaft 5, which is perpendicularly provided, in the port direction (clockwise) and in the starboard direction (counterclockwise). A pivoting apparatus 24 makes the swivel shaft 5 pivot by the intermediary of the steering arm 22 so as to pivot the outboard engine 21 on the swivel shaft 5. A pivoting angle detection sensor 23 detects the pivoting angle of the outboard engine 21 with respect to the swivel shaft 5, generates a pivoting angle signal corresponding to the detected pivoting angle, and inputs the pivoting angle signal to the control unit 14. The other configurations are the same as those in Embodiment 1.

In the case of a single-engine system, there exists no neighboring engine; therefore, the outboard engine 21 can always pivot within a range of the maximum limit angle, e.g., [deg] to −60 [deg]. Accordingly, the pivoting limit angle (port direction) single-engine map T2 and the pivoting limit angle (starboard direction) single-engine map T1 of the pivoting limit angle characteristic package in Embodiment 1 become the maximum limit angle in the steering mechanism in Embodiment 2.

Therefore, a pivoting limit angle characteristic package, among pivoting limit angle characteristic packages stored in the pivoting limit angle characteristic storage means 32 of the control unit 32, which corresponds to the type of a vessel or an outboard engine is selected and downloaded, and the pivoting limit angle (port direction) single-engine map T2 and the pivoting limit angle (starboard direction) single-engine map T1 of the pivoting limit angle characteristic package are utilized.

In the case of Embodiment 2, the steering angle detection means 13 is formed of a steering wheel sensor; the target pivoting angle setting means 29 in the control unit 14 performs detection of a signal from the steering wheel sensor and calculation of a target pivoting angle.

In addition, as the pivoting limit angle, a predetermined value for each of the right and left directions may be utilized instead of values in a map. Moreover, the steering angle detection means 13 may be configured with a steering wheel sensor and an electronic control unit that detects a signal from the steering wheel sensor; in this case, the electronic control unit performs calculation of a target pivoting angle. Furthermore, a signal line from the steering angle detection means 13 to the control unit 14 may be formed of a communication line such as the CAN.

Embodiment 3

Figure 22:
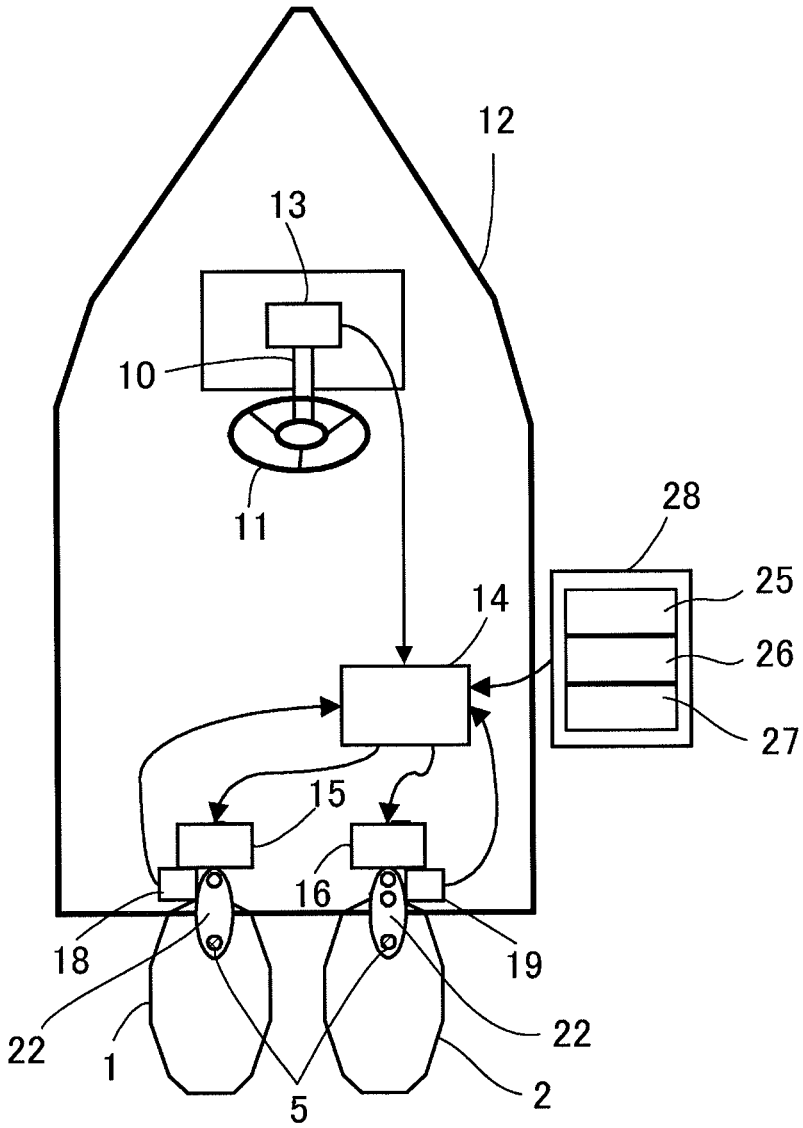
FIG. 22 is a configuration diagram representing a vessel steering system according to Embodiment 3 of the present invention.

FIG. 22 is a configuration diagram representing a vessel steering system according to Embodiment 3 of the present invention. The vessel steering system according to Embodiment 3 corresponds to a so-called two-engine system in which two outboard engines are provided at the stern of the vessel body 12.

In FIG. 22, the port outboard engine 1 is provided at the port side of the stern of the vessel body 12 in such a way that it can freely pivot on the swivel shaft 5, which is perpendicularly provided, in the port direction (clockwise) and in the starboard direction (counterclockwise). The port pivoting apparatus 18 makes the swivel shaft 5 pivot by the intermediary of the steering arm 22 so as to pivot the port outboard engine 1 on the swivel shaft 5 thereof. The starboard outboard engine 2 is provided at the starboard side of the stern of the vessel body 12 in such a way that it can freely pivot on the swivel shaft 5, which is perpendicularly provided, in the port direction (clockwise) and in the starboard direction (counterclockwise). The starboard pivoting apparatus 19 makes the swivel shaft 5 pivot by the intermediary of the steering arm 22 so as to pivot the starboard outboard engine 2 on the swivel shaft 5 thereof.

The port pivoting angle detection sensor 18 detects the pivoting angle of the port outboard engine 1 with respect to the swivel shaft 5, generates a pivoting angle signal corresponding to the detected pivoting angle, and inputs the pivoting angle signal to the control unit 14. The starboard pivoting angle detection sensor 19 detects the pivoting angle of the starboard outboard engine 2 with respect to the swivel shaft 5, generates a pivoting angle signal corresponding to the detected pivoting angle, and inputs the pivoting angle signal to the control unit 14. The other configurations are the same as those in Embodiment 1.

A two-engine system differs from a three-engine system in that there exists no middle outboard engine and hence calculation for a middle outboard engine is not required; the other controls are the same as those in the foregoing three-engine system according to Embodiment 1.

The present invention is not limited to the foregoing vessel steering systems according to Embodiments 1 through 3, but can be applied also to a vessel steering system equipped with more than three engines. A vessel steering system equipped with more than three engines differs from the three-engine system only in that the number of middle outboard engines increases; with regard to the added middle outboard engines, pivoting limit angle maps for a middle outboard engine are utilized.

In addition, in each of the foregoing embodiments, there has been explained a case where, as predetermined parameters, there is utilized a pivoting limit angle characteristic map in which the X axis denotes the actual pivoting angle of a neighboring outboard engine, the Y axis denotes the pivoting limit angle, and the Z axis denotes the distance between the swivel shaft of a reference outboard engine and the swivel shaft of a neighboring outboard engine thereof; however, as the predetermined parameters, there may be utilized a pivoting limit angle characteristic map in which the X axis denotes the actual pivoting angle of the neighboring outboard engine and the Y axis denotes the pivoting limit angle.

In the vessel steering system according to Embodiment 1 or 2 of the present invention, the respective pivoting limit angles of outboard engines are set by use of a pivoting limit angle characteristic stored in the storage means of the control unit, i.e., by use of predetermined parameters; however, as the pivoting limit angle for a reference outboard engine, there may be utilized the actual steering angle of the neighboring outboard engine situated in a direction in which the reference outboard engine pivots. For example, in the case of a three-engine system, when the actual pivoting angle of the middle outboard engine 3 is −10 [deg], the starboard-direction pivoting limit angle for the port outboard engine 1 is set to −10 [deg] so that the port outboard engine 1 can be prevented from pivoting by more than −10 [deg] in the starboard direction.

In addition, in Embodiments 1 through 3 of the present invention, the control pivoting angle is limited by the pivoting limit angle; however, the calculation of a pivoting limit angle performed in the step S160 in FIG. 20 may be carried out prior to the calculation of a control pivoting angle performed in the step S150 so that the target pivoting angle is limited by the pivoting limit angle.

Various modifications and alterations of this invention will be apparent to those skilled in the art without departing from the scope and spirit of this invention, and it should be understood that this is not limited to the illustrative embodiments set forth herein.

What is claimed is:

1. A vessel steering system, in which a propulsion unit provided on a vessel body is pivoted on a swivel shaft so that steering is performed, the vessel steering system comprising:

a control unit that calculates a control pivoting angle for pivoting the propulsion unit based on a steering angle obtained through steering manipulation by an operator; and a pivoting apparatus that pivots the propulsion unit based on the control pivoting angle calculated by the control unit, wherein the control unit selects a pivoting limit angle for limiting the pivoting of the propulsion unit from a plurality of pivot limit angles which limit the propulsion unit, based on recognition of at least one of the following characteristics: the type of the vessel, the type of the propulsion unit, an actual pivoting angle of a neighboring propulsion unit that is close to the propulsion unit when a plurality of propulsion unit is provided, the distance between the swivel shaft of a reference propulsion unit and the swivel shaft of a neighboring propulsion unit thereof at a time when a plurality of propulsion unit is provided, and the mounting position of the propulsion unit on the vessel, and wherein the control unit controls the pivoting apparatus in such a way that the propulsion unit pivots using the calculated control pivoting angle but does not pivot by more than the selected pivoting limit angle, and wherein the control unit further selects a pivoting limit angle for limiting the pivoting of the propulsion unit from a plurality of pivot limit angles which limit the propulsion unit based on recognition of at least two of the following characteristics: an actual pivoting angle of a neighboring propulsion unit that is close to the propulsion unit when a plurality of propulsion unit is provided, the distance between the swivel shaft of a reference propulsion unit and the swivel shaft of a neighboring propulsion unit thereof at a time when a plurality of propulsion unit is provided, and the mounting position of the propulsion unit on the vessel.

2. The vessel steering system according to claim 1, wherein the pivoting limit angle is a predetermined parameter.

3. The vessel steering system according to claim 1, wherein the plurality of pivoting limit angles are a plurality of pivoting limit angle characteristic maps in each of which the X axis denotes an actual pivoting angle of a neighboring propulsion unit, and the Y axis denotes the pivoting limit angle which is different from the Y axis of at least one other pivoting limit angle characteristic map from the plurality of pivoting limit angle characteristic maps.

4. The vessel steering system according to claim 1, wherein the plurality of pivoting limit angles are a plurality of pivoting limit angle characteristic maps in each of which the X axis denotes an actual pivoting angle of a neighboring propulsion unit, the Y axis denotes the pivoting limit angle, and the Z axis denotes the distance between the swivel shaft of a reference propulsion unit and the swivel shaft of the neighboring propulsion unit thereof which is different from the Z axis of at least one other pivoting limit angle characteristic map from the plurality of pivoting limit angle characteristic maps.

5. The vessel steering system according to claim 4, wherein the control unit is provided with a storage unit which stores the plurality of pivoting limit angle characteristic maps whose contents are different from one another, and based on at least one of: an actual pivoting angle of a neighboring propulsion unit that is close to the propulsion unit when a plurality of propulsion unit is provided and the distance between the swivel shaft of a reference propulsion unit and the swivel shaft of a neighboring propulsion unit thereof at a time when the plurality of propulsion unit is provided, selects one of the plurality of pivoting limit angle characteristic maps so as to set the pivoting limit angle.

6. The vessel steering system according to claim 5, wherein storage unit is formed of a nonvolatile memory.

7. The vessel steering system according to claim 1, wherein the selection of the pivoting limit angle characteristic map from the plurality of the pivoting limit angle characteristic maps is performed based on a command from an external tool connected with the control unit.

8. The vessel steering system according to claim 5, wherein information about which one of the plurality of pivoting limit angle characteristic maps has been selected is stored in the nonvolatile memory.

9. The vessel steering system according to claim 1, wherein the control unit is connected with an external tool in which the plurality of pivoting limit angle characteristic maps are stored, and the selected pivoting limit angle characteristic map stored in the external tool is downloaded to a storage unit, and based on the downloaded pivoting limit angle characteristic map, the pivoting limit angle is set.

10. The vessel steering system according to claim 1, wherein the pivoting limit angle map is selected based on the mounting position of a reference propulsion unit on the vessel body.

11. The vessel steering system according to claim 10, wherein the mounting position of the reference propulsion unit is determined in accordance with a command from the external tool connected with the control unit.

12. The vessel steering system according to claim 1, wherein recognition of at least one of the type of the vessel, the type of the propulsion unit, and the mounting position of the propulsion unit on the vessel body is performed based on a recognition signal transferred through communication from the vessel or the propulsion unit to the control unit.

13. The vessel steering system according to claim 1, wherein the distance between the swivel shaft of the reference propulsion unit and the swivel shaft of a neighboring propulsion unit is in at least one of the plurality of the pivoting limit angle characteristic maps, which are stored in the storage unit of the control unit.

14. The vessel steering system according to claim 1, wherein the control unit is configured in such a way as to calculate the control pivoting angle, based on an actual pivoting angle of the propulsion unit and a target pivoting angle calculated from a steering angle obtained through steering manipulation by the operator, and controls the pivoting apparatus in such a way that the propulsion unit does not pivot by more than the pivoting limit angle, by limiting the calculated control pivoting angle through the set pivoting limit angle.

15. The vessel steering system according to claim 1, wherein, in the case where a plurality of propulsion units is provided, the actual pivoting angle of a neighboring propulsion unit is utilized as a reference pivoting limit angle.

16. A vessel steering system, in which a propulsion unit provided on a vessel body is pivoted on a swivel shaft so that steering is performed, the vessel steering system comprising:

a control unit that calculates a control pivoting angle for pivoting the propulsion unit based on a steering angle obtained through steering manipulation by an operator; and a pivoting apparatus that pivots the propulsion unit based on the control pivoting angle calculated by the control unit, wherein based on recognition of the following characteristics: the type of the vessel, the type of the propulsion unit, an actual pivoting angle of a neighboring propulsion unit that is close to the propulsion unit when a plurality of propulsion unit is provided, the distance between the swivel shaft of a reference propulsion unit and the swivel shaft of a neighboring propulsion unit thereof at a time when a plurality of propulsion unit is provided, and the mounting position of the propulsion unit on the vessel; the control unit selects a pivoting limit angle for limiting the pivoting of the propulsion unit, and controls the pivoting apparatus in such a way that the propulsion unit does not pivot by more than the selected pivoting limit angle, and wherein the control unit further selects a pivoting limit angle for limiting the pivoting of the propulsion unit from a plurality of pivot limit angles which limit the propulsion unit based on recognition of at least two of the following characteristics: an actual pivoting angle of a neighboring propulsion unit that is close to the propulsion unit when a plurality of propulsion unit is provided, the distance between the swivel shaft of a reference propulsion unit and the swivel shaft of a neighboring propulsion unit thereof at a time when a plurality of propulsion unit is provided, and the mounting position of the propulsion unit on the vessel.

* * * * *